US011505965B2

(12) United States Patent
Matlock et al.

(10) Patent No.: US 11,505,965 B2
(45) Date of Patent: Nov. 22, 2022

(54) KEY OPERATED LOCK

(71) Applicant: U-CHANGE LOCK INDUSTRIES, INC., Mustang, OK (US)

(72) Inventors: Brian Matlock, Oklahoma City, OK (US); Mackenzy McClure, Mustang, OK (US)

(73) Assignee: U-CHANGE LOCK INDUSTRIES, INC., Mustang, OK (US)

( * ) Notice: Subject to any disclaimer, the term of this patent is extended or adjusted under 35 U.S.C. 154(b) by 365 days.

(21) Appl. No.: 16/623,639

(22) PCT Filed: Jun. 27, 2018

(86) PCT No.: PCT/US2018/039803

§ 371 (c)(1),
(2) Date: Dec. 17, 2019

(87) PCT Pub. No.: WO2019/005998

PCT Pub. Date: Jan. 3, 2019

(65) Prior Publication Data

US 2020/0224452 A1 Jul. 16, 2020

Related U.S. Application Data

(60) Provisional application No. 62/526,833, filed on Jun. 29, 2017.

(51) Int. Cl.
*E05B 27/00* (2006.01)
*E05B 35/00* (2006.01)

(52) U.S. Cl.
CPC ..... *E05B 27/005* (2013.01); *E05B 27/0021* (2013.01); *E05B 27/0053* (2013.01); *E05B 35/008* (2013.01); *E05B 27/0082* (2013.01)

(58) Field of Classification Search
CPC .... E05B 27/00; E05B 27/005; E05B 27/0021; E05B 27/0053; E05B 35/008; E05B 27/0082
USPC ..... 70/340–343, 382–384
See application file for complete search history.

(56) References Cited

U.S. PATENT DOCUMENTS 2,113,007 A * 4/1938 Swanson ..... E05B 27/005 70/385
2,427,837 A * 9/1947 Connell ..... E05B 17/08 70/385
2,818,723 A * 1/1958 Levin ..... E05B 27/005 70/338

(Continued)

FOREIGN PATENT DOCUMENTS

CA 954326 9/1974

OTHER PUBLICATIONS

International Search Report and Written Opinion dated Nov. 9, 2018, issued in corresponding PCT Application No. PCT/US2018/039803.

(Continued)

*Primary Examiner* — Suzanne L Barrett
(74) *Attorney, Agent, or Firm* — McAfee & Taft

(57) ABSTRACT

A key-operated lock comprising a housing, a core and a set of pin stacks. The housing has a set of driver chambers and a set of inactive master-pin chambers. Each pin stack comprises pin stack elements, which include a driver and a tumbler. The driver is movably mounted in one of the driver chambers. The tumbler assembly is movably mounted in the core for radial movement relative to the bore in the body. Further, the tumbler assemblies including a plurality of releasably engaged parts movable relative to each other upon disengagement to change a dimension of the tumbler assemblies. Additionally, for at least one of the pin stacks, the pin stack elements further comprise one or more master pins.

15 Claims, 21 Drawing Sheets

(56) References Cited

U.S. PATENT DOCUMENTS

| | | | | | |
|---|---|---|---|---|---|
| 3,667,262 | A | * | 6/1972 | Hill | E05B 27/00 70/375 |
| 4,116,026 | A | * | 9/1978 | Flint | E05B 27/005 70/383 |
| 4,440,009 | A | | 4/1984 | Smith | |
| 4,631,941 | A | * | 12/1986 | Sjunnesson | E05B 27/0053 70/389 |
| 4,732,023 | A | * | 3/1988 | Shen | E05B 27/005 70/378 |
| 4,741,188 | A | | 5/1988 | Smith | |
| 4,747,281 | A | * | 5/1988 | Monahan | E05B 27/005 70/385 |
| 4,836,002 | A | * | 6/1989 | Monahan | E05B 27/005 70/385 |
| 5,138,856 | A | * | 8/1992 | Chyun | E05B 27/001 70/419 |
| 5,799,519 | A | * | 9/1998 | Hsiao | E05B 27/005 70/358 |
| 6,935,146 | B1 | | 8/2005 | Lin | |
| 7,290,418 | B2 | | 11/2007 | Herdman | |
| 7,526,935 | B2 | | 5/2009 | Huang et al. | |
| 8,161,783 | B2 | | 4/2012 | Huang et al. | |
| 2004/0221630 | A1 | * | 11/2004 | Herdman | E05B 27/005 70/382 |
| 2010/0050717 | A1 | | 3/2010 | Chiang et al. | |

OTHER PUBLICATIONS

European Search Report dated Mar. 2, 2021, issued in corresponding European Application No. 18823607.9.

* cited by examiner

BEFORE BASIC REKEY

TMK INSERTED

CURRENT CHANGE KEY INSERTED

BASIC REKEY PROCESS

CURRENT CHANGE KEY INSERTED
(KEY INSERT/PULL POSITION)

CURRENT CHANGE KEY INSERTED
(BASIC REKEY POSITION)

NEW CHANGE KEY INSERTED
(BASIC REKEY POSITION)

NEW CHANGE KEY INSERTED
(KEY INSERT/PULL POSITION)

AFTER BASIC REKEY

BEFORE TMK REKEY

CURRENT TMK INSERTED

CURRENT CHANGE KEY INSERTED

TMK REKEY PROCESS

CURRENT CHANGE KEY INSERTED
(KEY INSERT/PULL POSITION)

CURRENT CHANGE KEY INSERTED
(BASIC REKEY POSITION)

CURRENT TMK KEY INSERTED
(BASIC REKEY POSITION)

CURRENT TMK KEY INSERTED
(TMK REKEY POSITION)

TMK REKEY PROCESS CONT'D

CURRENT TMK KEY INSERTED
W/ CHANGE TOOL INSERTED
(TMK REKEY POSITION)

CURRENT TMK KEY REMOVED
W/ CHANGE TOOL INSERTED
(TMK REKEY POSITION)

NEW TMK KEY INSERTED
W/ CHANGE TOOL REMOVED
(TMK REKEY POSITION)

NEW TMK KEY INSERTED
(BASIC REKEY POSITION)

TMK REKEY PROCESS CONT'D

AFTER TMK REKEY

PREVIOUS TMK INSERTED

NEW TMK INSERTED

PREVIOUS CHANGE KEY INSERTED

NEW CHANGE KEY INSERTED

KEY OPERATED LOCK

CROSS-REFERENCE TO RELATED APPLICATION

This application claims the benefit of U.S. Provisional Application No. 62/526,833 filed Jun. 29, 2017, which is hereby incorporated by reference.

FIELD

The present disclosure relates generally to improve key operated locks. More particularly, but not by way of limitation, this disclosure relates to an improved key operated lock incorporating mechanisms adapted to permit the lock to be easily and rapidly changed for operation by different individual keys, and also to be changed so that a selected master key can be utilized for opening a number of such locks.

BACKGROUND

Business establishments, or even homes, often desire to be able to change one or more locks so that the key normally used for opening the lock is changed, and an old key which has previously been operative to open the lock will no longer work. Moreover, preferred locks are of the type adapted to having the tumblers forming portions of the lock mechanism changed in their operative status relative to each other without the necessity of disassembling the lock, or removing it from the door in which it is located.

In various business establishments such as motels, hotels, and chains of department stores, a great many locks are frequently utilized. In most cases, the business desires a master key which will unlock any one of these locks in the event persons in possession of the regular keys for unlocking the locks are unavailable or to allow one master key to access various locks which require separate change keys (also called "patron keys"). With the provision of one or more master keys, which are maintained in the custody of a few selected personnel, the versatility of this type of lock in a multi-lock situation is increased. Situations arise, however, from time to time, in which a custodian of a master key leaves the employ of the organization where the locks are utilized, and, through inadvertence or intent, takes one of the master keys which will unlock any of the locks in use of the type described, and will continue to unlock such locks even though the dimensions of the tumblers in the locks may be changed to accommodate new individual change keys. The security of the establishment is obviously compromised by the loss of master keys in this manner, and the usefulness of the lock is enhanced if it can be changed so that master keys, which would previously effectively unlock or open the lock, can no longer be used, and new master keys are required for this purpose. The usefulness of the lock is further enhanced, if it can be changed to accommodate a new master key without the necessity for removing the lock from the door or disassembling the lock.

Previously proposed locks having provisions for changing the patron key combination and the master key combination have not proved entirely satisfactory as they employ a large number of intricate parts and are extremely complex in construction and operation. Certain of these locks have relatively large physical dimensions and are therefore limited to specific applications. Also, the number of permutations to which the combination may be changed has been severely limited. In addition, certain of these previously proposed locks require special keys, which are significantly different from conventional keys.

SUMMARY

In accordance with one series of embodiments of the current disclosure, there is provided a key-operated lock comprising a housing, a core (generally, known in the industry as a plug) and a set of pin stacks. The housing has a circularly cross-sectioned bore therein defined by a bore wall. The bore has an axial direction. The housing has a set of driver chambers aligned along the axial direction with each driver chamber extending radially towards the bore. Further, the housing has a set of inactive master-pin chambers aligned along the axial direction with each inactive master-pin chamber extending radially towards the bore. The set of inactive master-pin chambers are spaced circumferentially around the bore from the set of driver chambers and each inactive master-pin chamber aligns circumferentially with a respective driver chamber.

The core is rotatably mounted in the bore and has a main key slot and a change tool slot formed therein. Both the main key slot and change tool slot extend substantially parallel to the axial direction. The core has an outer cylindrical surface which meets the bore wall at a shear line.

Each pin stack comprises pin stack elements, which include a driver and a tumbler. The driver is movably mounted in one of the driver chambers for radial movement relative to the bore in the housing, and for movement partially into the bore in the housing. The tumbler assembly is movably mounted in the core for radial movement relative to the bore in the body and moveable to a position projecting from the core. In a key-pull position of the core, the tumbler assembly is radially aligned with the driver. Further, the tumbler assemblies including a plurality of releasably engaged parts movable relative to each other upon disengagement to change a dimension of the tumbler assemblies. The releasably engaged parts are disengaged by insertion of a change tool into the change tool slot when the core is in a top-master-rekey position.

Additionally, for at least one of the pin stacks, the pin stack elements further comprise one or more master pins. Each master pin is moveable between a position within the core above the respective tumbler assembly and a position in the inactive master-pin chamber when the core is in a basic rekey position (also called patron rekey position) in which the tumbler assembly is radially aligned with the set of inactive master-pin chambers.

Generally, the pin stack elements meet at shear points such that, when all the pin stacks have shear points coincident with the shear line, the core is free to rotate in the bore at least among the first position, the second position and the third position. When at least one of the pin stacks does not have a shear point coincident with the shear line, the core is not free to rotate.

In most embodiments, when a top-master key is inserted into the main key slot, all the shear points associated with all the tumbler assemblies are coincident with the shear line. The lock is configured such that the top-master key can be changed by changing the dimension of the tumbler assemblies when the lock is in the top-master rekey position.

In many embodiments, when a current patron key is inserted into the main key slot, at least one shear point associated with one of the master pins and either another master pin or the driver is coincident with the shear line.

Further, the lock can be configured such that the patron key can be changed by moving at least one master pin between the position within the core above the respective tumbler assembly and the position in the inactive master-pin chamber.

In another set of embodiments, there is a key-operated lock comprising a housing, a core rotatably mounted in the housing; a plurality of master pins in a first configuration to allow a first patron key to open the lock; and a plurality of reconfigurable tumbler assemblies in a first arrangement to allow a first master key to open the lock.

The housing, the core, the plurality of master pins and the plurality of pin stacks are configured to have:

- a key pull position in which at least the first master key and the first patron key are insertable into the lock so as to be able to lock and unlock the lock;
- a basic rekey position in which the plurality of master pins are reconfigured by inserting a second patron key into a second configuration, wherein in the second configuration, the first patron key is not able to lock and unlock the lock from the key pull position and the second patron key is able to lock and unlock the lock from the key pull position; and
- a top-master rekey position in which the reconfigurable tumbler is reconfigured by insertion of a change tool and a second master key into a second arrangement, wherein in the second arrangement the first master key and first patron key are not able to lock and unlock the lock from the key pull position and the second master key is able to lock and unlock the lock from the key pull position.

In some of these embodiments, each reconfigurable tumbler assembly comprises a plurality of releasably engaged parts movable relative to each other upon disengagement to change a dimension of the tumbler assemblies. The releasably engaged parts are disengaged by insertion of the change tool into a change tool slot in the core when the lock is in the top-master-rekey position.

Each reconfigurable tumbler assembly can be a part of a pin stack such that there are a plurality of pin stacks in the lock. At least one of the pin stacks can include at least one master pin. The master pin is moveable in and out of the pin stack in the basic rekey position. Additionally, the housing can have a set of inactive master-pin chambers which retains master pins which are not in one of the pin stacks.

In some of the embodiments, the key-operated lock is configured to have a grandmaster key, a master key and a patron key and wherein the master key and patron key are slave keys to the grandmaster key.

Other embodiments provide for a method of rekeying a key-operated lock comprising:

- inserting a current patron key into a main key slot of a core rotatably mounted in a bore of a housing when the core is in a key-pull position wherein a set of tumbler assemblies mounted in the core is radially aligned with a set of drivers mounted in the housing, and wherein the tumbler assemblies are movably mounted in the core for radial movement relative to the bore in the body and moveable to a position projecting from the core;
- turning the patron key to thus turn the core to a basic rekey position wherein the set of tumbler assemblies is radially aligned with a set of master pin chambers;
- removing the current patron key;
- inserting a current top-master key;
- turning the current top-master key so as to move the core to a top-master rekey position;
- inserting a change tool into a change tool slot in the core, wherein each tumbler assembly of the set of tumbler assemblies includes a plurality of releasably engaged parts movable relative to each other upon disengagement to change to the dimension of the tumbler assembly, and wherein insertion of the change tool disengages the releasably engaged parts when the core is in the second rekey position;
- removing the current top-master key;
- inserting a new top-master key wherein inserting the new top-master key changes a dimension of at least one of the tumbler assemblies;
- removing the change tool so as to reengage the releasably engaged parts thus rekeying the lock for the new top-master key;
- turning the top-master key so as to move the core to the basic rekey position;
- removing the new top-master key; and
- inserting a new patron key such that one or more master pins move between a position in the inactive master-pin chamber and a position within the core above one of the tumbler assemblies thus rekeying the lock for the new patron key.

BRIEF DESCRIPTION OF THE DRAWINGS

FIG. 6 illustrates the core rotated to the top-master rekey position with all master pins in the inactive master pin chambers.

DETAILED DESCRIPTION

Figure 1:
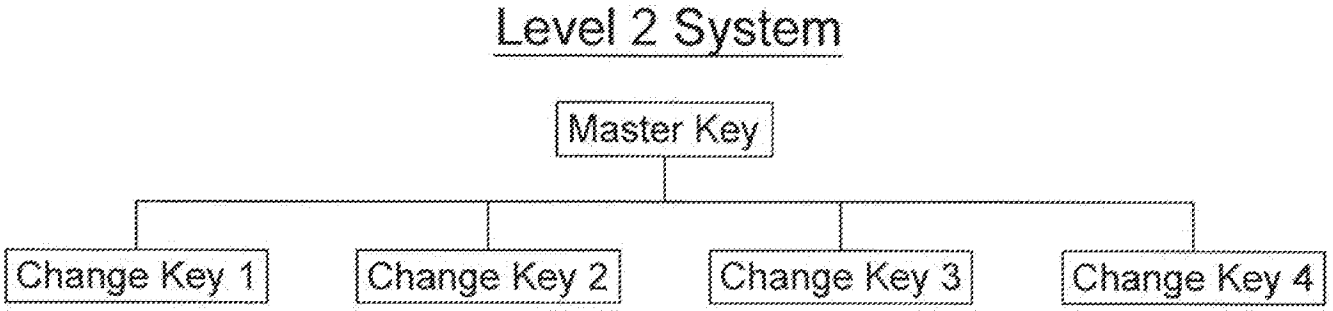
FIG. 1 is a diagram of a level 2 system, which could be used in a hotel, for example.

In the description that follows, like parts are marked throughout the specification and drawings with the same reference numerals, respectively. The drawings are not necessarily to scale and the proportions of certain parts have been exaggerated to better illustrate details and features of the invention. In the following description unless the context would indicate otherwise, the terms "inward", "outward", "lower" and "upper" are directions toward and away from, respectively, the geometric axis of a referenced object. Accordingly, "inward" means towards the center or geometric axis, and "lower" refers to a first point radially inward from a second point. Likewise, "outward" means away from the center or geometric axis, and "upper" refers to a first point radially outward from a second point. Where components of relatively well-known designs are employed, their structure and operation will not be described in detail.

As used herein, the following terms will have the following meanings.

"Patron key" as used herein refers generally to a key that operates a specific lock and not other locks. When such a lock can be rekeyed to use a different patron key, the patron key is typically referred to as a "change key". In this disclosure, "change keys" will often be referred to as "patron keys".

"Master key" refers to a key that can operate on several keyed different locks. These locks are configured to operate with two, or more, different keys: one specific to each lock (the "patron key" or "change key") which cannot operate any of the other locks in the set, and the master key, which operates all the locks in the set. In some embodiments, there can be a "grandmaster key" or "top-master key" that can operate all the locks in multiple sets of locks. In such embodiments, there typically are master keys and individual patron keys. The "master keys" are keys that can open all the locks of one of the set of locks but not locks in other sets. The "individual patron keys" are keys that can only open a specific lock in one of the sets of locks.

"Slave key" refers to a particular patron key that will only operate a lock if its associated master key also operates the lock. If the cylinder is rekeyed to a new master key, the previous master and previous patron key will no longer operate the cylinder.

"Level 2 system" means a lock system (a group of two or more locks) with patron keys and a master key. For example, a level 2 system for a hotel is shown in FIG. 1.

Figure 2:
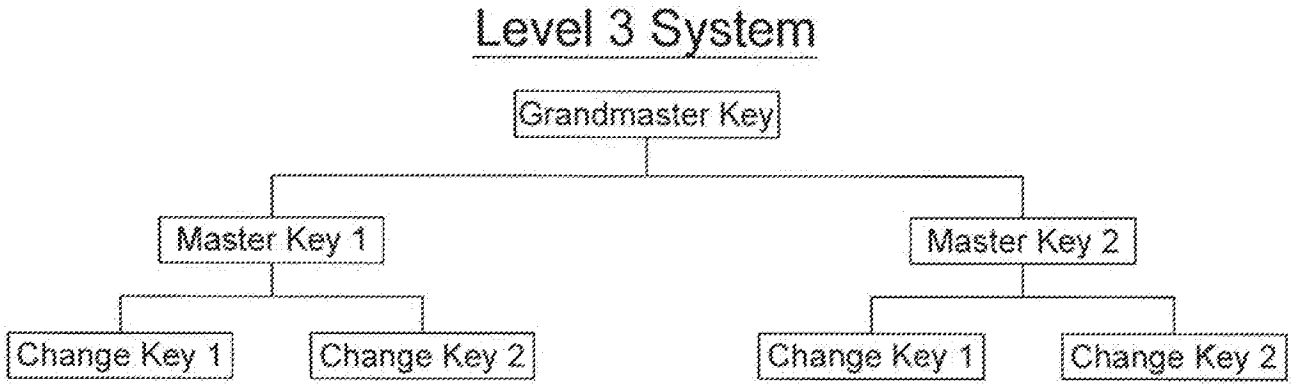
FIG. 2 is a diagram of a level 3 system, which could be used in a hotel, for example.

"Level 3 system" means a lock system with a top-master key (or grandmaster key), master keys and individual patron keys. For example, a level 3 system for a hotel is shown in FIG. 2.

"Key-pull position" means the position where the sub-holes (containing the tumbler pins) on the core align with the active driver chambers on the housing. This is the natural locked position of the cylinder.

"Shear line" is where the outside diameter of the core and the inside diameter of the housing meet. When an interface (shear points) of elements for each pin stack coincides with the shear line, the core is able to be rotated to unlock the lock.

The above definitions are to facilitate understanding, the meaning of the above terms, components used in the definition, and other components can be further understood by reference to the below description of embodiments.

Figure 3:
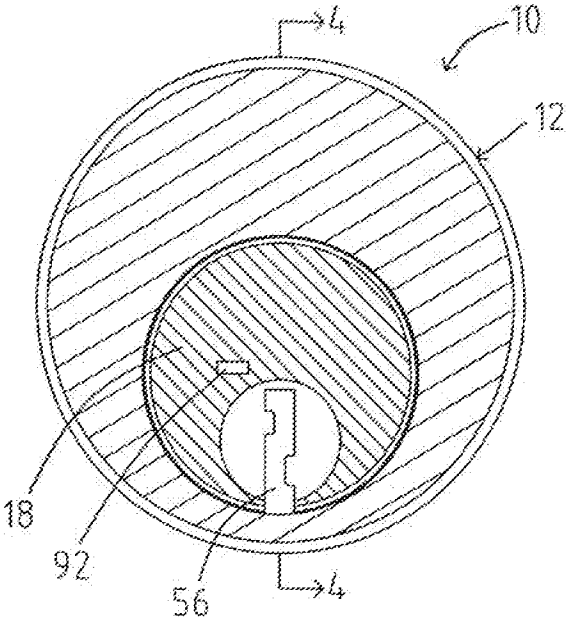
FIG. 3 is a front end elevation view of a key operated lock constructed in accordance with one embodiment.
Figure 5:
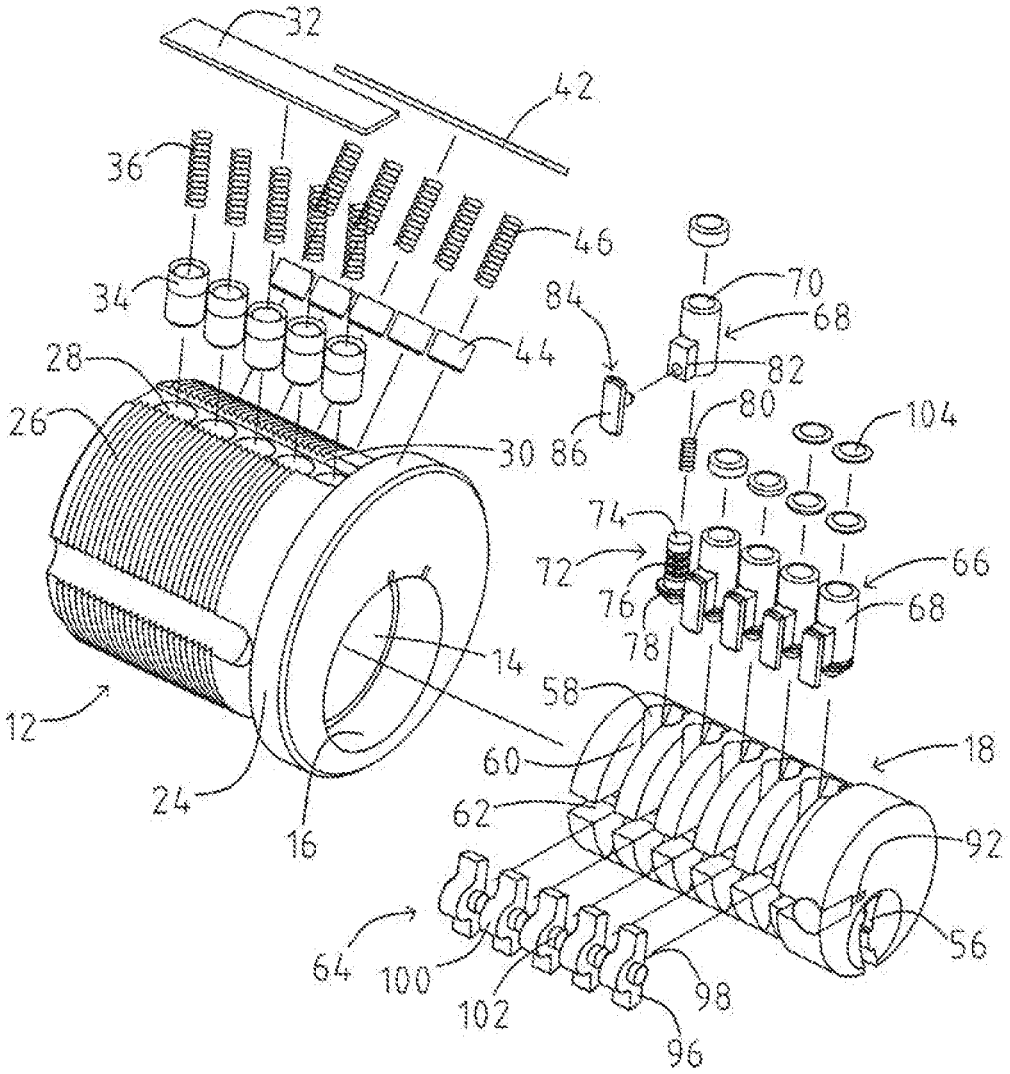
FIG. 5 is an exploded view of the key operated lock of FIG. 3.

Referring initially to FIG. 3 of the drawings, the key operated lock 10 of the invention includes a housing 12 which is illustrated as being generally cylindrical in form and is sometimes referred to in the trade as the "cylinder" or "shell". Housing 12 has a cylindrical bore 14 defined by circumferential-extending wall 16 (see FIG. 5) extending therethrough. An elongated core 18, which is preferably generally cylindrical in configuration, is rotatably mounted in cylindrical bore 14 in housing 12.

As can be seen most clearly in FIGS. 4-8, housing 12 can include a circumferential flange 24 which extends around one end of housing 12. The purpose of the flange 24 is to abut the face of a door or other member in which the lock is to be installed. Housing 12 can have an external thread 26 which is provided to secure the lock in the door or other member where the lock is to be used.

Housing 12 has a set of apertures 28 which extend radially through wall 16 of housing 12 to cylindrical bore 14. Typically, the set of apertures will comprise a plurality of apertures 28, which are often referred to as "driver chambers". An elongated, dove-tailed groove or slot 30 extends from one end of housing 12 to flange 24 and is provided to accommodate a cover plate 32 which, when placed in slot 30, covers apertures 28 in the body.

An active driver 34 is slidingly positioned in each of apertures 28 in housing 12. Each active driver 34 is constantly urged toward the core 18 by a driver spring 36, which has one of its ends disposed in a recess or bore in the respective driver 34 and its opposite end abutting the elongated cover plate 32, as can best be seen by the sectional view of a driver in FIG. 4.

Housing 12 has a second set of apertures 38, which extend radially through wall 16 of housing 12 to cylindrical bore 14. Typically, the set of apertures will comprise a plurality of apertures 38, which will also be referred to as "inactive master-pin chambers" (see FIGS. 6, 7A and 7B). An elongated, dove-tailed groove or slot 40 extends from one end of housing 12 to flange 24 and is provided to accommodate a cover plate 42 which, when placed in slot 40, covers apertures 38 in the body.

A master-pin driver 44 is slidingly positioned in each of apertures 38 in housing 12. Each master-pin driver 44 is constantly urged toward the core 18 by a driver spring 46, which has one of its ends disposed in a recess or bore in the respective driver 44 and its opposite end abutting the elongated cover plate 42.

Housing 12 has a shallow counterbore 48 in the end thereof which carries flange 24, and this counterbore intersects the cylindrical bore 14 at a shoulder 50. Core 18 is provided at one of its ends with an annular flange 52 dimensioned to rotatably fit within counterbore 48 and abut against shoulder 50 when core 18 is inserted in cylindrical bore 14 in housing 12. At the end of core 18 opposite the flange 52, the core has secured thereto in any suitable manner (such as by screws or the like) a lock cam 54 which serves the dual purposes of preventing core 18 from moving toward the forward end of the lock within housing 12, and to actuate a lock bolt (not shown) in a manner well understood in the art.

Figure 4:
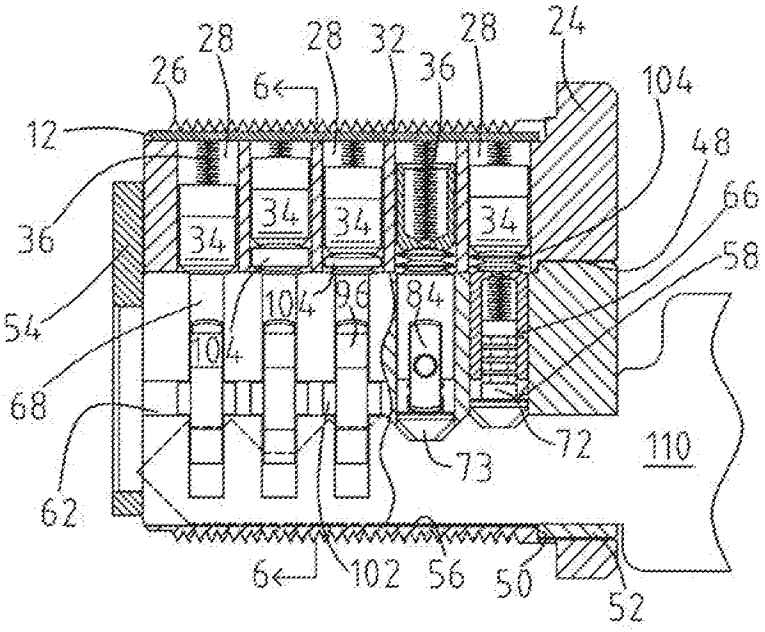
FIG. 4 is a sectional view taken along line 4-4 of FIG. 3.

A key slot 56 extends longitudinally through core 18 and is suitably configured to accept a key for operating the lock. The key used in the key slot 56 may be an individual patron key for everyday usage, a master key, or a top-master (grandmaster) key. FIG. 4 illustrates top-master key 110 in key slot 56.

A plurality of apertures 58 extend radially in core 18 and have one end in communication with the key slot 56. Apertures 58 open at the outer periphery of core 18 and are positioned to register with apertures 28 in housing 12 when the core 18 is in the key-pull position in housing 12 as shown in FIGS. 3 and 4. The apertures 58, in the illustrated embodiment of the invention, are each generally cylindrical in configuration but connect with semicircular slots 60 which are transversally intersected by slot 62 that runs longitudinally along core 18, best seen from FIG. 5. Slots 60 and 62 are dimensioned to receive sidebar 64, and apertures 58 are each dimensioned to receive a generally cylindrical tumbler assembly 66, and such that tumbler assembly 66 and sidebar 64 can interact as described below.

Tumbler assembly 66 operates in place of more typical static tumbler pins. As best seen from FIGS. 5 and 8, core 18 has a plurality of tumbler assemblies 66. Each of the tumbler assemblies 66 includes a hollow cylindrical housing or retainer sleeve 68 which is closed at one end 70 thereof and slidingly disposed within one of the cylindrical apertures 58 in core 18. Slidingly disposed within the interior of the sleeve 68 is an extensible member or plunger 72 which has an upper portion 74 carrying a plurality of spaced circumferential ribs or flanges 76, and a lower portion 78 having a tapered face 73, which, when installed in lock 10, extends into key slot 56 to a position for contacting a key inserted in the slot as depicted in FIG. 4 and hereinafter described in greater detail.

A spring member 80 is provided between the closed end 70 of sleeve 68 and the upper portion 74 of the plunger 72 to constantly urge the plunger away from closed end 70 of sleeve 68 and toward the main key slot 56.

A hollow projection 82 extends outwardly from one side of sleeve 68 and is adapted to receive a portion of a retainer pin 84. Retainer pin 84 is of T-shaped configuration and includes a projecting flange portion 86, a barrel 88, and a tip 90 formed on the end of the barrel which is opposite the flange portion 76 (see FIG. 8). Barrel 88 of retainer pin 84 projects through a bore formed in hollow projection 82 which extends outwardly from one side of sleeve 68. It will further be noted, that the tip 90 of retainer pin 84 projects between the spaced, circumferential ribs 76 of the upper portion 74 of the extensible member 72. Retainer pin 84 thus functions to engage sleeve 68 of the tumbler assembly 66 with the extensible member 72.

Figure 6:
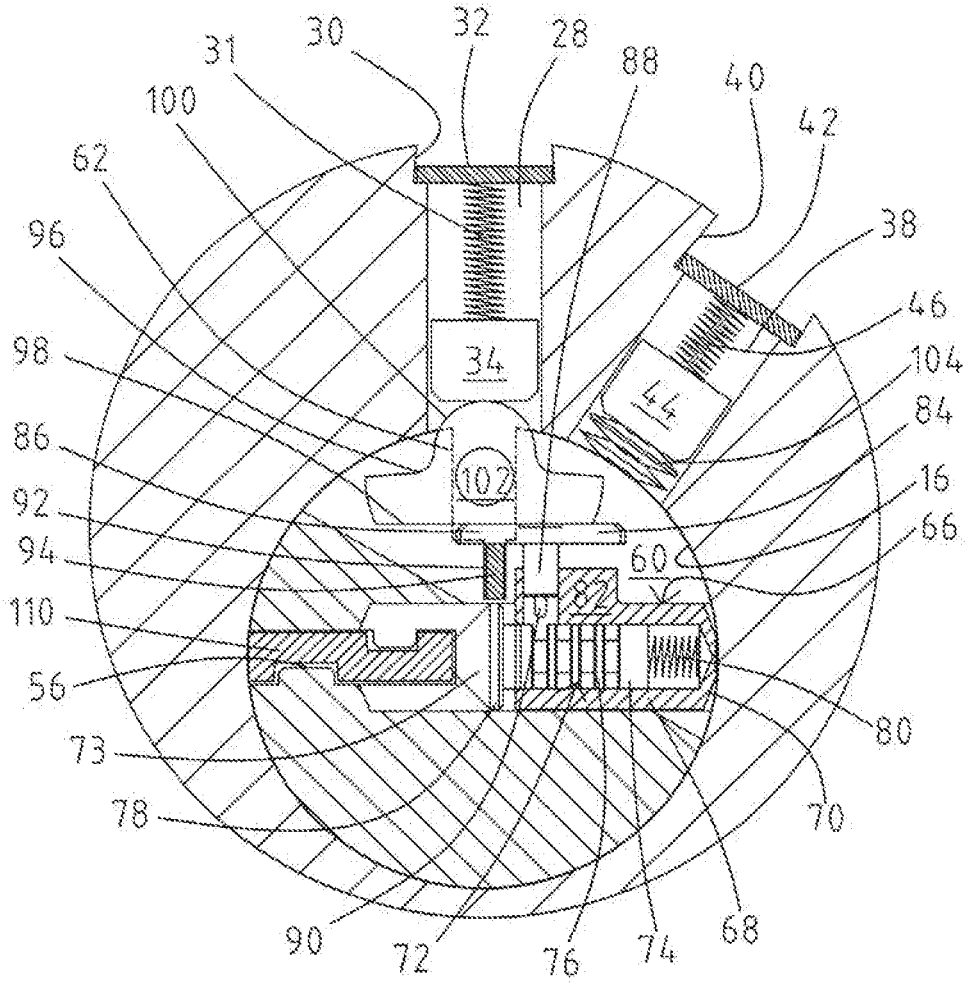
FIG. 6 is a sectional view taken along line 6-6 of FIG. 4, except that FIG. 4 is in the key pull position with all master pins in the driver chamber.
Figure 7B:
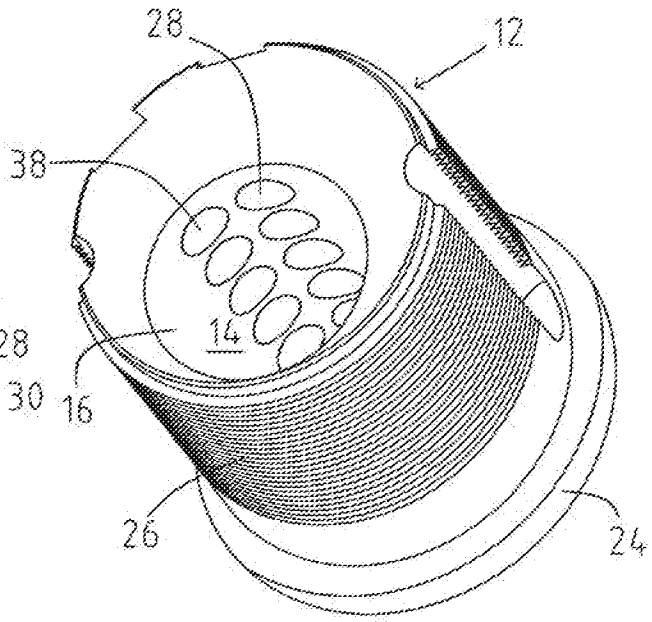
FIGS. 7A and 7B are rear perspective views of the lock housing.
Figure 7A:
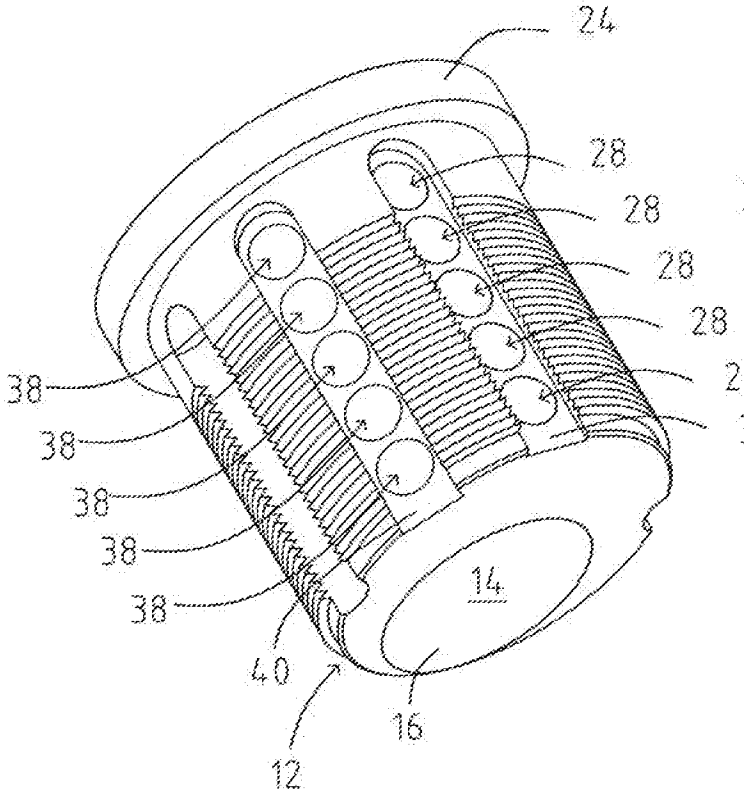
Figure 8:
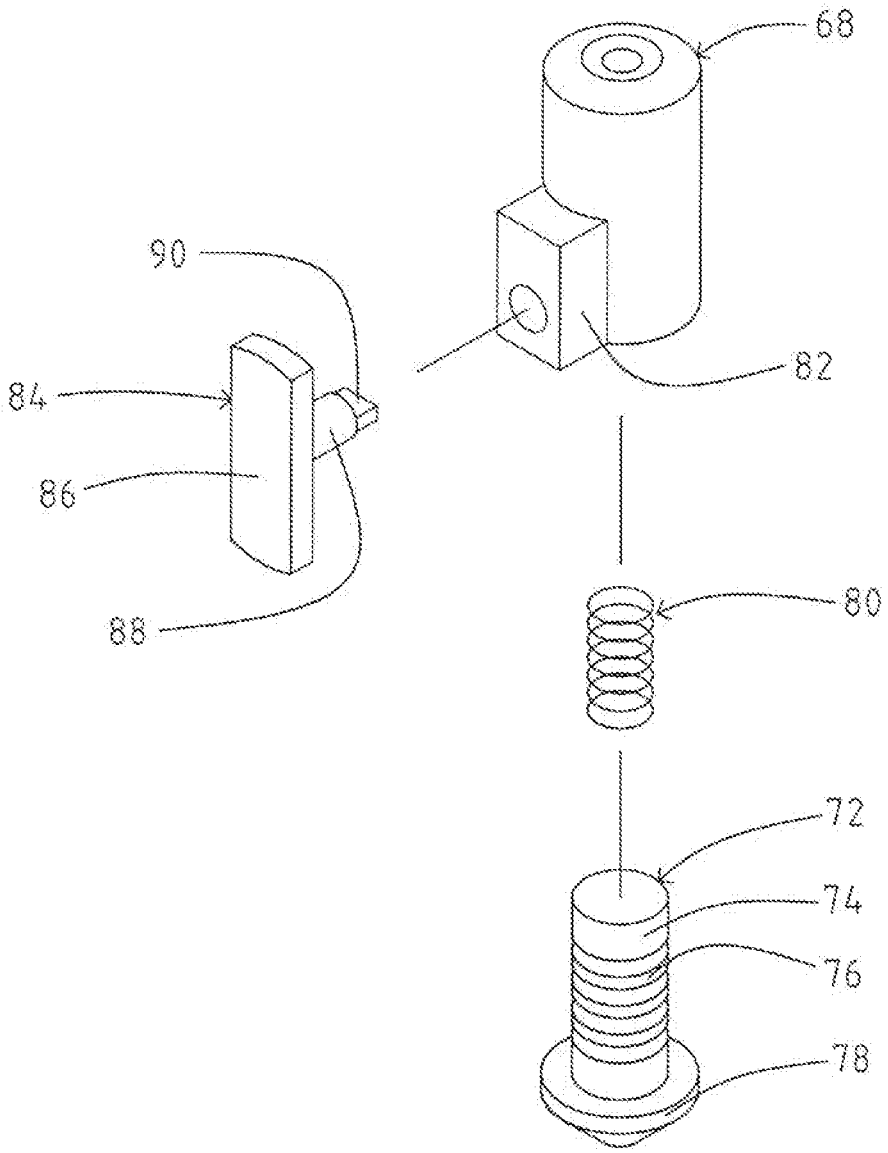
FIG. 8 is an exploded view of a tumbler assembly shown in FIG. 5.

As discussed above, each of the generally cylindrical apertures 58 formed in core 18 opens at one of its sides into a substantially semicircular slot 60 cut radially inwardly into the side of core 18 and of the general configuration shown in FIG. 6. There is one of the slots 60 cut in the body of core 18 in correspondence to each one of the apertures 58, with the series of longitudinally spaced slots 60 in core 18 registering with the series of radially extending, longitudinally spaced apertures 58 formed therein. The series of slots 60 cut in one side of core 18 are intersected by a longitudinally extending slot 62 cut along a major portion of the length of the core and extending from the outer surface of the core in a radially inward direction. At its base, longitudinally extending slot 62 intersects a relatively small, axially extending change tool slot 92 which extends through core 18 in a direction parallel to slot 62. This relationship is perhaps best illustrated in FIG. 6 of the drawings where a change tool 94 is depicted in position in the change tool slot 92, and the upper portion of the longitudinally extending slot 62 is perceptible in dashed lines.

Sidebar 64 comprises a series of cam plates 96 which work in a cooperating relationship with each of the tumbler assemblies 66. The cam plate 96 has a flat surface 98 which bears against the flange 86 of the retainer pin 84 and has a rounded cam surface 100 on the opposite side of the cam plate from the flat surface. One of the cam plates 96 is provided for contact with each of the retainer pins 84, and each cam plate 96 is elongated and relatively thin in configuration as can be seen in referring to these elements in FIGS. 5 and 6.

Each of the cam plates 96 has locating pins 102 projecting from the opposite sides thereof. The cam plates 96 are positioned in the several semicircular slots 60 with locating pins 102 extending into the longitudinal slot 62 in core 18 in the manner best illustrated in FIG. 4. The cam surfaces 100 of the several cam plates 96, in most positions of core 18 within housing 12, bears against cylindrical wall 16 of bore 14 in the housing. In one position (the "top-master-rekey position") to which core 18 may be rotated, however, cam surfaces 100 of the several cam plates 96 are aligned with the driver chambers 28 in housing 12 which receive the active drivers 34. This position of the cam plates is depicted in FIG. 6. It will be noted that when core 18 is rotated to the position shown in FIG. 6, cam plates 96 may be moved radially outwardly, as may the retainer pins 84 with which these plates are in contact. As will be subsequently explained, this status of the lock permits change tool 94 to be utilized for biasing retainer pins 84 to a disengaging status so that the extensible members 72 and retainer sleeve 68 may undergo movement relatively to each other.

Lock 10 further utilizes master pins 104. Each master pin 104 is a small pin that can sit between closed end 70 of one of the tumbler assemblies 66 and the bottom of the corresponding active driver 34. When a master pin is between closed end 70 and the active driver 34, it creates additional interfaces or shear points, which can align with the shear line of lock 10. Thus, the master pins allow for multiple keys to turn core 18. Each tumbler assembly 66 and its corresponding active driver 34 comprise a basic pin stack. In the basic pin stack, the pin stack elements (tumbler assembly 66 and active driver 34) provide a shear point at the interface of closed end 70 with active driver 34. If no master pins are present in any of the pin stacks, then only the top-master key can turn core 18 and thus unlock the lock. In most embodiments of the invention, at least a portion of the pin stacks will contain one or more master pins. In these pin stacks, there will be additional shear points based on the interface of the master pin interfaces with the bottom of active driver 34, closed end 70 of tumbler assembly 66, or with another master pin. For example, if one master pin 104 is present in a pin stack then there will be two shear points, one at the interface of the master pin with closed end 70 of tumbler assembly 66 and the other at the interface of the master pin with the bottom of active driver 34. The first or lower of these shear points allows the top-master key to turn core 18; the latter or upper of these shear points allows a patron key to turn core 18. If two master pins 104 are present in a pin stack, then there will be three shear points, one at the interface of the lower master pin with closed end 70 of tumbler assembly 66, a second at the interface of upper master pin and lower master pin, and the third at the interface of the upper master pin with the bottom of active driver 34. The first or lower of these shear points allows the top-master key to turn core 18; the second (middle) shear point and third (upper) shear point can allow for two different keys to turn core 18. However, generally only the upper shear point will be used for the key progression as discussed in the Key Progression section.

Figure 10:
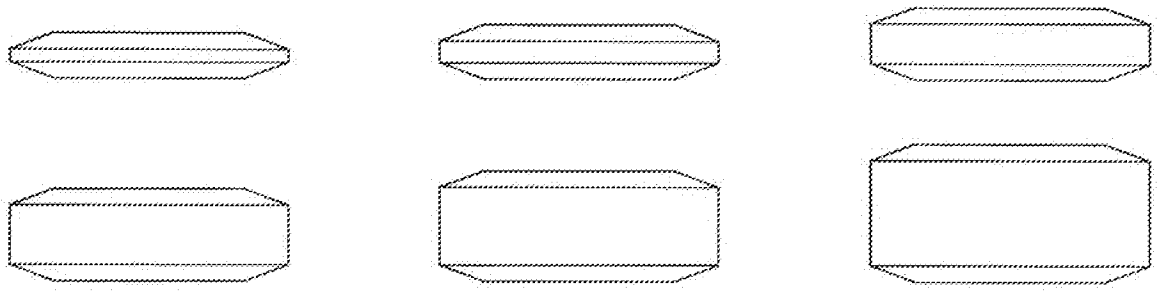
FIG. 10 is a side view of several different master pins suitable for use in some embodiments.
Figure 9:
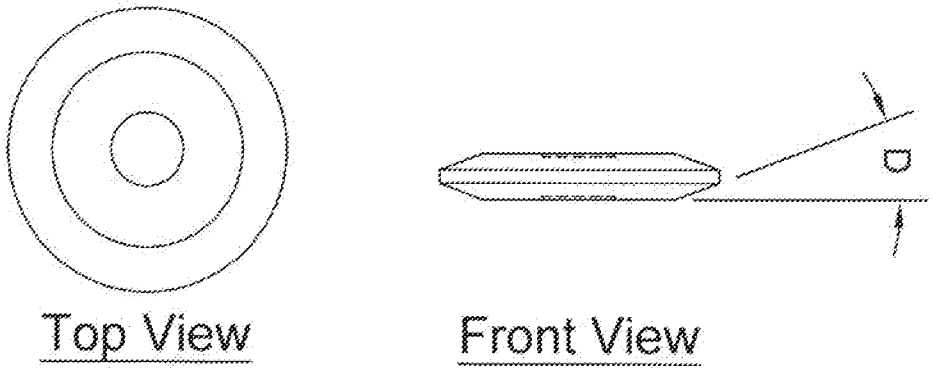
FIG. 9 is a top and side view of a master pin suitable for use in some embodiments.

As shown in FIG. 9, in one embodiment the master pins are disc shaped pins having beveled or angled edges to facilitate movement rotation of core 18 when the interface is aligned at the shear line. The edges can have an angle D from about 10° to about 45°, more typically from about 15° to about 30°. As illustrated in FIG. 10, the master pins can have different thicknesses to provide for better security and more combinations for key configurations. In one embodiment, the master pins can have from 3 to 8 different thicknesses. As illustrated, the master pins have 6 different thicknesses.

When not in use, master pins 104 are positioned in apertures or inactive master-pin chambers 38. As will be appreciated by one skilled in the art based on this disclosure, movement of the master pins 104 between the pin stacks and inactive master-pin chambers 38 allows rekeying of lock 10 to be operated by different patron keys, some of which can be master keys to others which are individual patron keys. A master pin 104 can be moved between a pin stack and a corresponding inactive master-pin chamber 38 by a process further described below.

The embodiments of the current lock structure use a single type of key and a change tool. The patron keys and top-master key are of the same type or same configuration and differ only in the milled surface. The top-master key is milled to unlock all the locks of a set of locks, while patron keys are milled to unlock only a few specific individual locks of the set or one specific individual lock in the set of locks. If the patron key is milled to unlock a few specific locks of the set of locks it is a master key coming under or slave to the top-master key. If the patron key is milled to unlock only a specific individual lock, it is an individual patron key coming under the master key and the top-master key and a slave to both. As described below, the patron keys (including a master key in a level 3 system) for any specific individual lock can be changed without utilizing any special tool other than the current patron key and a new patron key. Additionally as described below, the top-master key can be changed for any specific individual lock but requires the current patron key, current top-master key and the change tool.

Operation

As may be understood by one skilled in the art based on the above disclosure and will be understood by the below disclosure, the current lock allows rekeying to the top-master key (grandmaster key) by manipulation of the tumbler assemblies and basic rekeying of the patron keys and master keys (in a level 3 system) is by manipulation of the master pins.

The general operation of key lock structures, which include cooperating drivers and tumbler pins aligning at a shear line, is generally well understood in the art. Locks of this type may be opened at such time as the drivers and the tumbler pins cooperate to permit a cylindrical core 18 to be rotated within a housing. Such rotation of the core causes a lock cam to be moved against a lock bolt so as to release the door from its surrounding frame and permit the door to be opened.

The nomenclature "change key lock" is used herein to refer to locks of the type with the capability to be changed in their internal mechanism so that a key which has previously been effective for unlocking the lock will no longer perform this function, but rather, a new key must be used for this purpose. In the past, systems for change key locks typically could not accommodate both level 2 systems and level 3 systems and have easy operation of the rekeying of the lock. Often such change key locks only provided for level 2 systems or had complicated and hard to implement rekeying operations. Additionally, many such change key locks relied on master keys or top-master keys having unique configurations from the patron keys. Thus, they had to incorporate multiple key holes or rely on complicated key holes that could accommodate two different key configurations.

The embodiments of the present lock 10 provide for the use of a top-master key having the same configuration as the patron key but a different milled surface. Thus, the top-master key and patron key use the same configuration of key hole. Additionally, the embodiments provide for an easy system of rekeying the lock to use different patron keys and an easy system for rekeying the lock to use a different top-master key.

Basic Rekeying Method

Figure 11A:
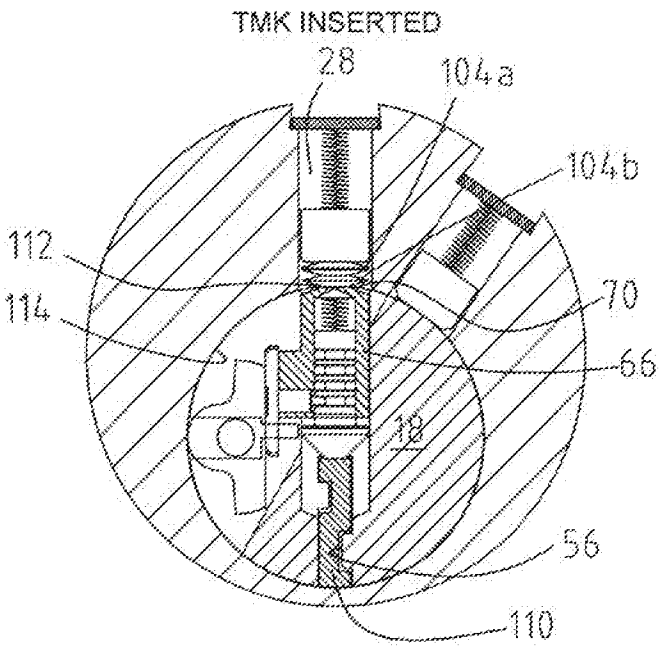
FIGS. 11A-I are cut-a-way front views of the key operated lock of FIG. 3, as operated by a top-master key and individual patron keys, and illustrating rekeying the lock for a different patron key.
Figure 11B:
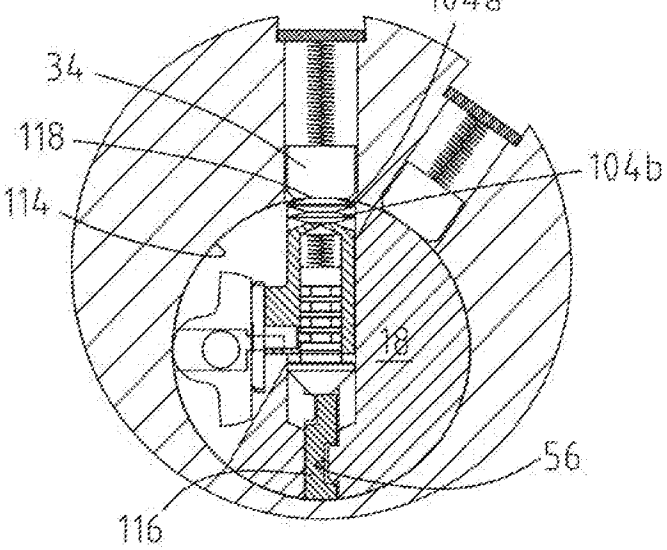

Rekeying of the lock to use different patron keys but to retain the same top-master key will now be described with reference to FIGS. 11A-11I, wherein the views are from the front of housing 12. FIGS. 11A and 11B illustrate the use of the initial top-master key and initial patron key, those prior to rekeying. As will be appreciated from FIG. 11A, when the initial top-master key 110 is inserted into key slot 56, all the shear points 112 associated with end 70 of all the tumbler assemblies 66 are coincident with the shear line 114. As can be seen, master pins 104 are above the shear line and are within driver chamber 28. Accordingly, when core 18 is turned, the master pins will remain within driver chamber 28. As illustrated in FIG. 11B, when initial individual patron key 116 is inserted into key slot 56, then at least one of the pin stacks will have a shear point 118 coincident with the shear line 114 such that the shear point 118 will be between a master pin and the active driver. As illustrated, the shear point 118 is between a master pin 104*a* and active driver 34. As can be seen, master pin 104*a* is below the shear line and is within aperture 58 of core 18. Accordingly, when core 18 is turned, master pin 104*a* will remain in aperture 58 and move with core 18.

Figure 11C:
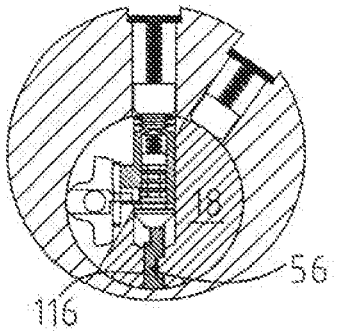
Figure 11D:
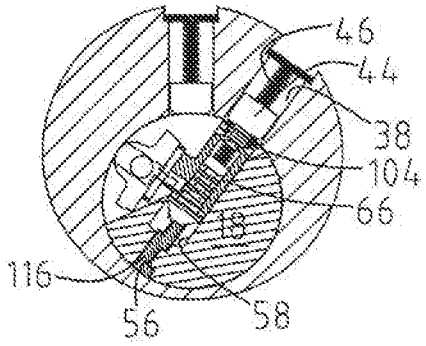
Figure 11E:
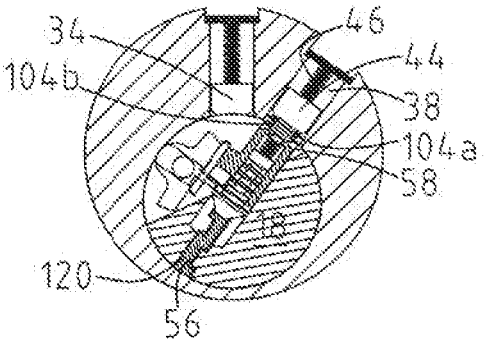
Figure 11F:
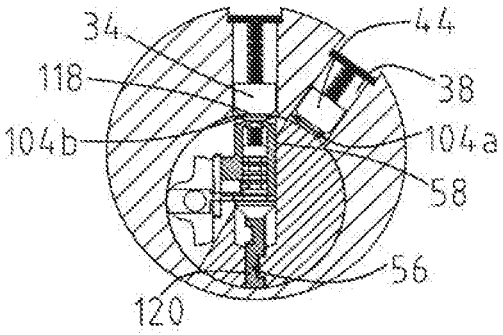

In order to accomplish rekeying for a new individual patron key, the initial individual patron key 116 is inserted into key slot 56 in the key-pull position, as shown in FIG. 11C. Core 18 is then turned to a basic rekey position, shown in FIG. 11D as being at about 35° from the key-pull position, but can be any suitable position. In this position, apertures 58 and tumbler assemblies 66 are aligned with inactive master-pin chambers 38. Driver spring 46 keeps master pins 104 in aperture 58. The current individual patron key is withdrawn and a new individual patron key 120 is inserted, as shown in FIG. 11E. New individual patron key 120 has a different milled surface sufficient to partially compress driver spring 46; thus, its insertion causes at least one master pin 104 to move between an inactive master-pin chamber 38 and the corresponding aperture 58. As is illustrated, upper master pin 104*a* is moved into inactive master-pin chamber 38 and lower master pin 104*b* remains in aperture 58. Subsequently, when core 18 is turned back to the key-pull position as shown in FIG. 11F, only one master pin 104*b* is part of the lock stack assembly and its interface with active driver 34 is the shear point 118 used by new patron key 120.

Figures 11G, 11H, 11I:
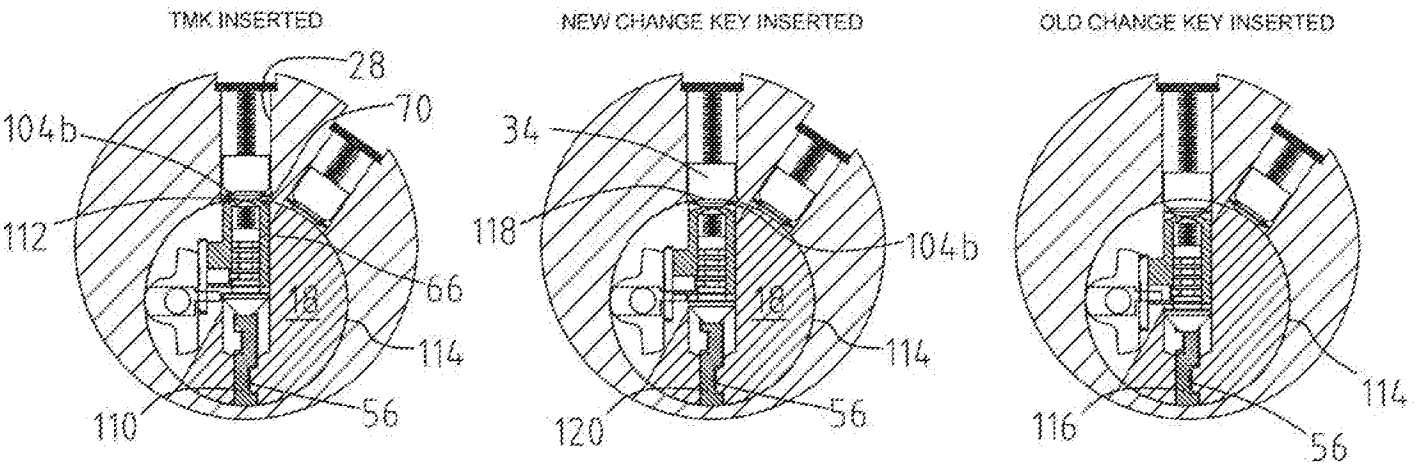

The lock is now rekeyed for the new individual patron key 120, which may be withdrawn from key slot 56. For example, as shown in FIGS. 11A and 11B, there are two master pins 104*a* and 104*b* associated with the illustrated pin stack for initial patron key 116. After rekeying, there is one master pin 104*b* associated with the illustrated pin stack for new patron key 120, as shown in FIG. 11F. After rekeying, the initial top-master key 110 can be inserted into key slot 56 and the shear points 112 associated with end 70 of all the tumbler assemblies 66 are still coincident with the shear line 114, as shown in FIG. 11G. As can be seen, master pin 104*b* is above the shear line and is within driver chamber 28. Accordingly, when core 18 is turned, master pin 104*b* will remain within driver chamber 28. As illustrated in FIG. 11H, when the new patron key 120 is inserted in key slot 56, then shear point 118 between active driver 34 and master pin 104*b* coincides with the shear line 114. However, as shown in FIG. 11I, when initial individual patron key 116 is inserted into key slot 56, the illustrated pin stack has no shear point coinciding with shear line 114. Accordingly, initial top-master key 110 and new patron key 120 will operate the lock after rekeying but initial patron key 116 will not.

Accordingly, in changing the individual patron key, the master pins 104 in use in the pin stacks are changed so that these pin stacks will no longer cooperate with the milled surface of individual patron key 116 (previously operative to unlock the lock) in such a way that unlocking can be accomplished. Rather, the change in master pins results in the pin stacks accommodating a new and different individual patron key 120, having a different milled surface which is correlated to the particular pin stack configuration dictated by the master pins 104 present in the pin stack after the change is effected. The above description is only for illustrative purposes, in actual practice master pins can be moved from more than one of the pin stacks, and master pins may be either added to or removed from a pin stack during rekeying. Additionally, for any particular pin stack zero, one, two or more master pins may be moved between any particular pin stack and its associated inactive master-pin chamber. However, for rekeying at the patron key level, at least one pin stack will have at least one master pin added or removed during rekeying. Also, while described for individual patron keys, it will be apparent that the same procedure can be carried out for any patron key whether an individual patron key or a level 2 master key within a level 3 system.

Top-Master Rekeying Method

Figure 12A:
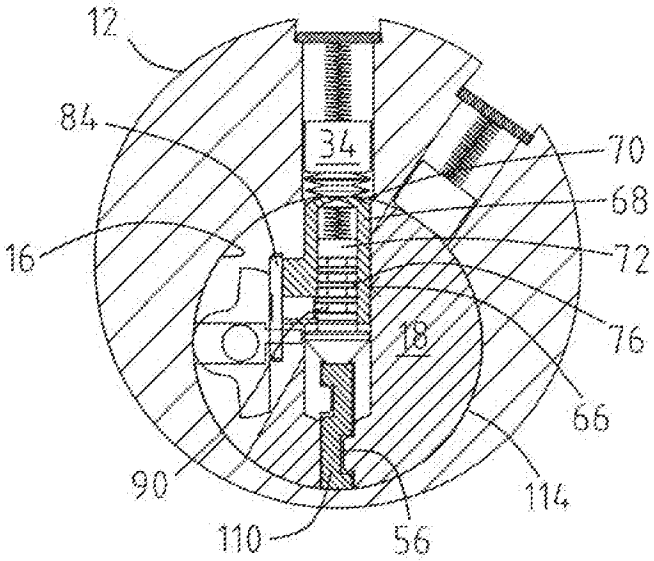
FIGS. 12A-P are cut-a-way front views of the key operated lock of FIG. 3, as operated by a top-master key and individual patron keys, and illustrating rekeying the lock for a different top-master key.
Figure 12B:
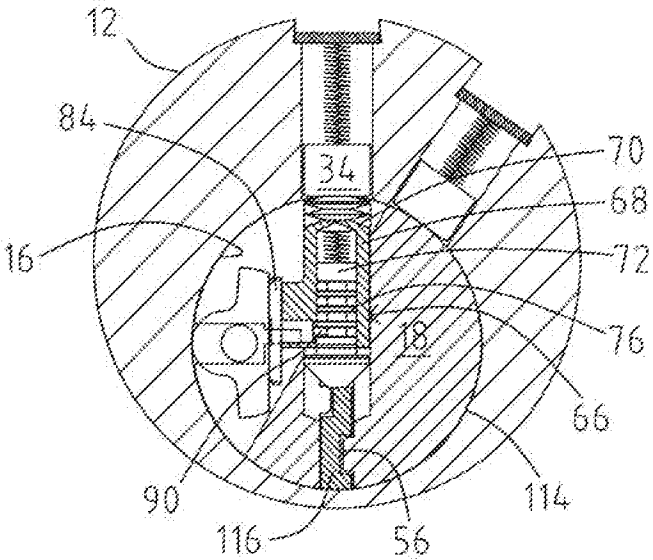

Rekeying of the lock to use a different top-master key and a different patron key will now be described with reference to FIGS. 12A-12P, wherein the views are from the front of housing 12 (the end with lock cam 54). FIGS. 12A and 12B illustrate the use of the initial top-master key and initial patron key, those prior to rekeying. As will be appreciated, FIG. 12A and FIG. 12B are substantially the same as FIGS. 11A and 11B. From the discussion above, one skilled in the art will appreciate that the overall dimensions of the tumbler assemblies are fixed by the particular interlocking position of the tip 90 of the retainer pins 84 with the ribs 76 of the plungers 72. Thus, upon insertion of the initial top-master key 110, which is to be rendered inoperative, tumbler assemblies 66 are moved such that the closed upper ends 70 of the sleeves 68 are positioned in alignment along a meeting line in contact with the active drivers 34. This meeting line coincides with shear line 114 between the outer periphery of core 18 and wall 16 defining the bore through housing 12. With the active drivers 34 and tumbler assemblies 66 in this position relative to each other, core 18 can then rotate within cylindrical bore 14 in housing 12.

Figure 12C:
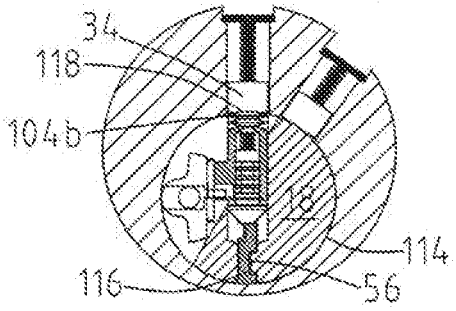
Figure 12D:
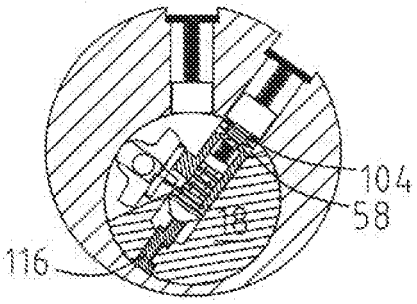
Figure 12E:
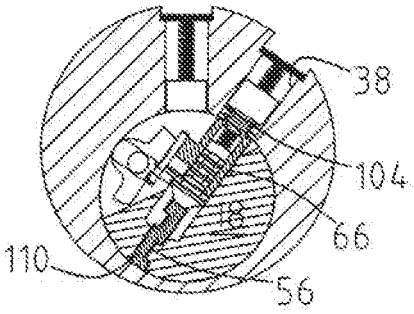

In order to accomplish rekeying for the top-master key and patron key, the current individual patron key 116 is inserted into key slot 56, as shown in FIG. 12C. Patron key 116 is the current lowest or basic individual patron key; thus, for any pin stack containing master pins, the shear point which aligns with shear line 114 for patron key 116 is shear point 118 between the upper master pin 104*b* and active driver 34. Core 18 is then turned to the basic rekey position. As core 18 is turned, it carries any master pins currently in use within apertures 58. The initial individual patron key 116 is withdrawn and the initial top-master key 110 is inserted, as shown in FIG. 12E. Initial top-master key 110 has a milled surface which, in corporation with the current dimensions of tumbler assembly 66, pushes master pins 104 into inactive master-pin chamber 38.

Figure 12F:
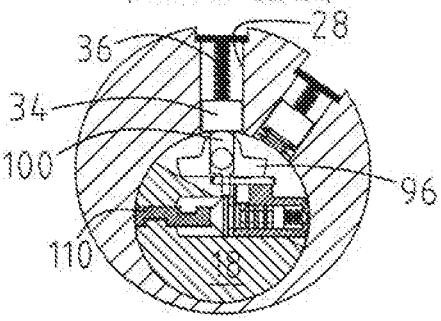

Core 18 is then turned using the initial top-master key 110 to a top-master-rekey position, shown in FIG. 12F as being about 90° from the key-pull position, but it can be at any suitable position. When core 18 is in this position with initial top-master key 110 located therein, the cam plates 96 are positioned in alignment with driver apertures 28. Thus, cam surfaces 100 of cam plates 96 bear against the inner ends of active drivers 34 in driver apertures 28, and active drivers 34 may thus be biased outwardly in their respective apertures 28 against the force resiliently exerted by the springs 36.

Figure 12G:
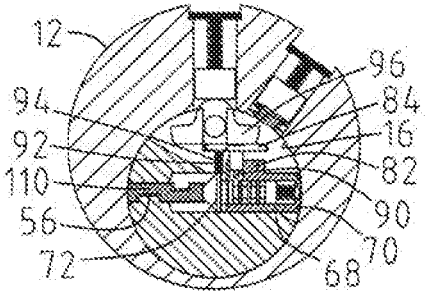
Figure 12H:
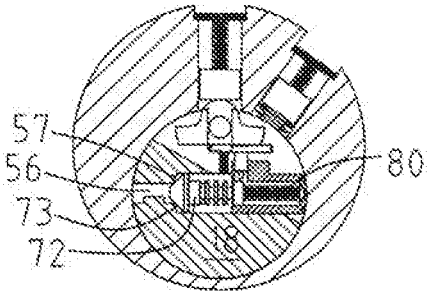
Figure 13:
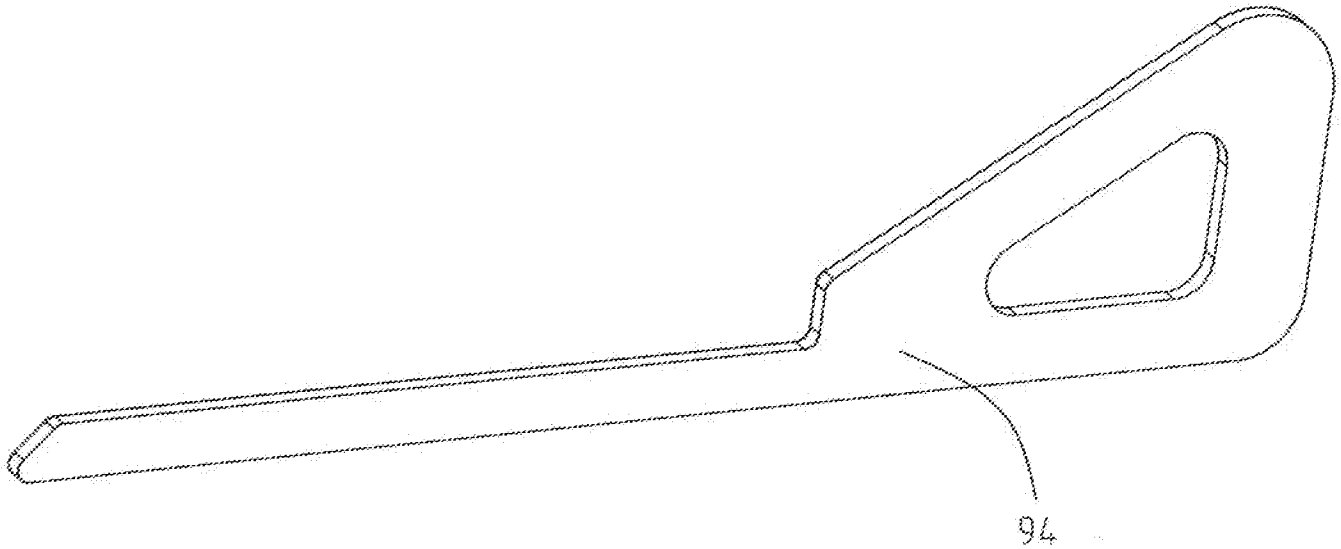
FIG. 13 is a schematic view of a change tool suitable for use in some embodiments.

With the lock in the status described, a change tool 94, of the type shown in FIG. 13, is inserted in the change tool slot 92 and then comes to occupy the position with respect to the retainer pins 84 and cam plates 96 which is illustrated in FIG. 12G and FIG. 12H of the drawings. The change tool 94, when inserted in this manner, effectively biases the several retainer pins 84 outwardly with respect to the hollow projections 82. This movement of the retainer pins 84 is possible because the cam plates 96 are, at this time, free to move radially outwardly against the active drivers 34, which can move outwardly in their respective driver chambers 28. There is thus effected a disengagement of tips 90 of the several retainer pins 84 from plungers 72. The plungers 72 thus become free to move relative to retaining sleeves 68. The retaining sleeves 68 are immovable at this time due to the abutment of the closed ends 70 thereof against wall 16 defining the bore in housing 12.

At this time, initial top-master key 110 can be removed from the main key slot 56, as shown in FIG. 12H. This permits plungers 72 to be biased by their respective springs 80 to a position where the tapered face 73 of each plunger 72 adjacent to key slot 56 bears against a shoulder 57 formed within core 18. At this point, the movement of the respective plunger 72 is arrested. With change tool 94 remaining in position, a new top-master key 122 is then inserted in key slot 56, as shown in FIG. 12 (*i*). This effectively biases plungers 72 to new positions which are determined by the geometric configuration of the milled edge of new top-master key 122 placed in key slot 56. It also changes the relative positions of the several tips 90 on retainer pins 84 with respect to the ribs 76 formed around the shanks of plungers 72.

Figure 12I:
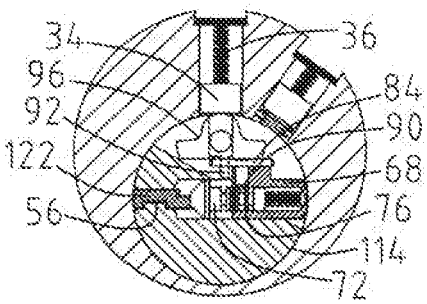
Figure 12J:
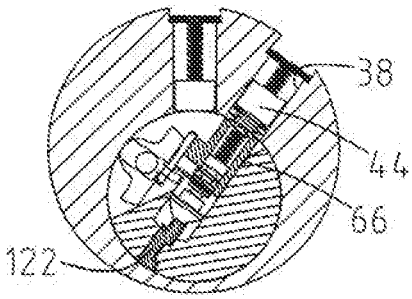

After new top-master key 122 has been inserted, the change tool 94 is removed from the change tool slot 92, as shown in FIG. 12I. This permits retainer pins 84 to respond to the bias of springs 36 exerted through active drivers 34 and cam plates 96, and to return to their position of engagement with plungers 72 by extension of tips 90 between adjacent pairs of the spaced ribs 76. It will be perceived that the effect of the actions described is to readjust the overall lengthwise dimension of the several tumbler assemblies so that they are correlated to new top-master key 122, and this new top-master key, when inserted in key slot 56, will result in the retainer sleeve 68 of the several tumbler assemblies 66 being biased to the shear line 114 necessary to open the lock as previously described. Core 18 may then be rotated to the basic rekey position as viewed in FIG. 12J.

Figure 12L:
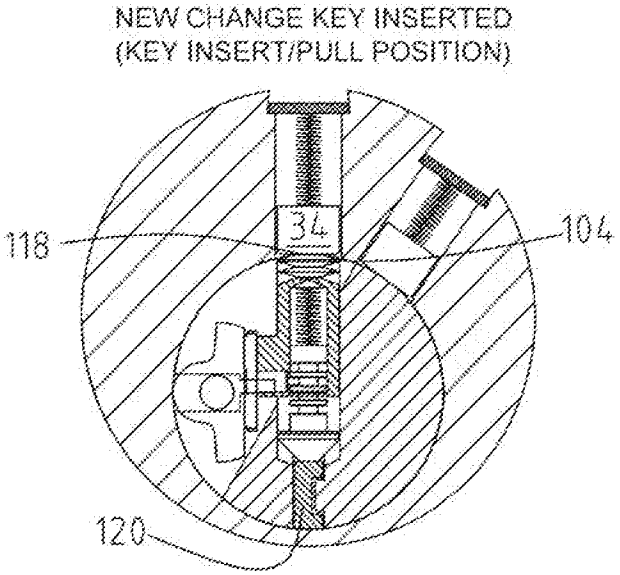
Figure 12K:
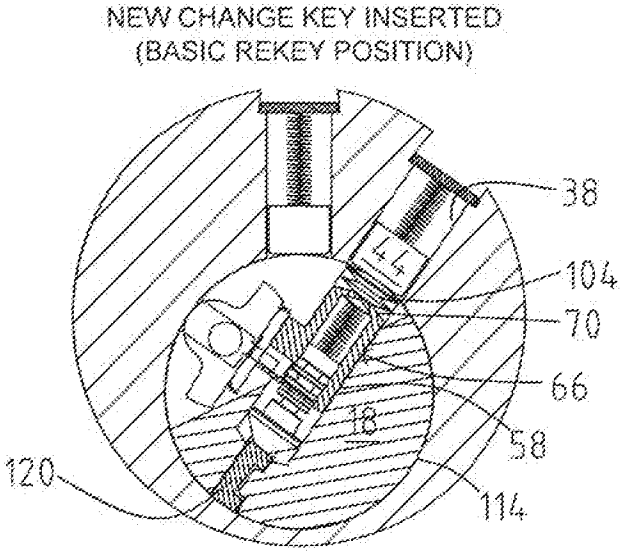

In the basic rekey position, the new top-master key 122 is withdrawn and a new patron key 120 is inserted as illustrated in FIG. 12K. New patron key 120 typically has a different milled surface than the initial patron key 116, initial top-master key 110 and new top-master key 122. The milling of new patron key 120 is such that, for at least one of the several tumbler assemblies 66, closed end 70 is within apertures 58 of core 18 and not immediately adjacent to shear line 114; thus, its insertion causes master pins 104 to move between at least one of the inactive master-pin chambers 38 and the corresponding aperture 58 in core 18. Subsequently, when core 18 is turned back to the key-pull position as shown in FIG. 12L, one or more master pins 104 are part of at least one of the lock stack assemblies, and the master pin interface with active driver 34 is shear point 118 used by new patron key 120. As further described below in the Key Progression Section, typically the first new patron key used, after rekeying to a new top-master key, will drop all of the master pins below the shear line and bring them all into the active drive chambers. Having all the master pins in use ensures that, after future rekeys of patron keys, no previous patron keys will continue to operate the lock.

Figure 12M:
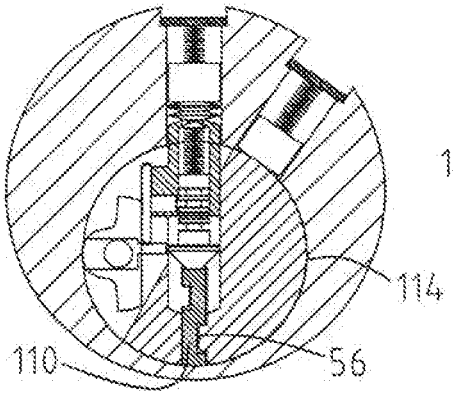
Figure 12N:
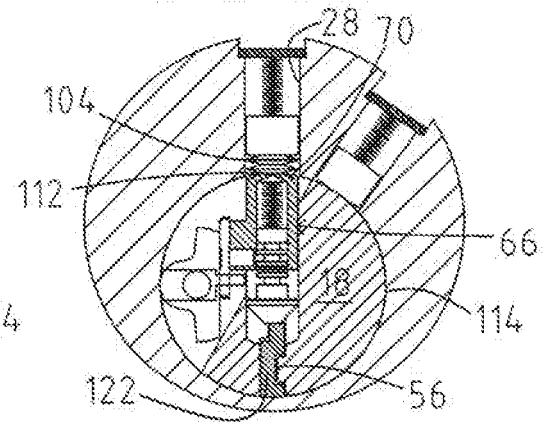
Figure 12O:
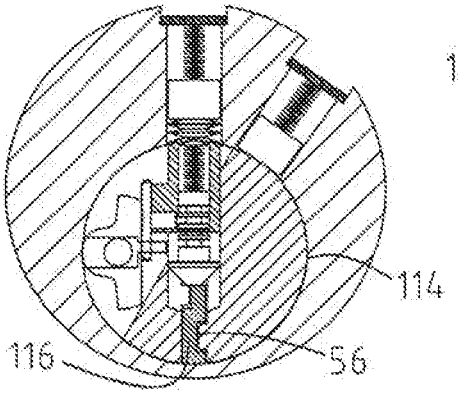
Figure 12P:
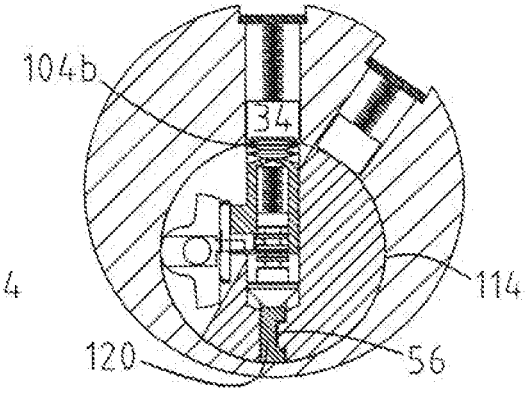

The lock is now rekeyed for the new top-master key 122 and new patron key 120. After rekeying, the initial top-master key 110 can be inserted into key slot 56 as shown in FIG. 12M. As will be noted, the insertion of initial top-master key 110 does not result in any shear points coinciding with shear line 114. Accordingly, initial top-master key 110 can no longer operate the lock. When new top-master key 122 is inserted into key slot 56, the shear points 112 associated with end 70 of all the tumbler assembly 66 is coincident with the shear line 114, as shown in FIG. 12N. Thus, new top-master key can operate the lock. As can be seen, master pins 104 are above shear line 114 and are within driver chamber 28. Accordingly, when core 18 is turned, master pins 104 will remain within driver chamber 28. Further, if initial patron key 116 is inserted in key slot 56 as illustrated in FIG. 12O, no shear points coincide with shear line 114; thus, initial patron key 116 cannot operate the lock. However, when the new patron key 120 is inserted in key slot 56 as illustrated in FIG. 12P, then shear point 118 between active driver 34 and master pin 104 coincides with shear line 114. Accordingly, new top-master key 122 and new patron key 120 will operate the lock after rekeying, but initial top-master key 110 and initial patron key 116 will not.

Key Progression

To understand the invention better, certain embodiments relating to key progressions during rekeying will now be described. As will be clear from the above, each driver chamber 28 has a core aperture 58 associated with it, and each driver chamber/core aperture combination has a pin stack associated with it. In the described embodiment, the key has a number of cut-depth positions equal to the number pin stacks in the lock, which is the same as the number of driver chamber/core aperture combinations. The described embodiments use two different bases for cut depths for each cut-depth position so as to align a shear point in the pin stack associated with the cut-depth position with the shear line 114. The first cut depth (associated with the top-master key) will align bottom shear point 112 associated with end 70 of the tumbler assembly 66 with shear line 114. The second cut depth (associated with a change key) will align the top shear point 118 (between the bottom of the driver and the top of the upper master pin) with the shear line 114. As will be appreciated, if no master pins are in a pin stack, then the change key uses the cut depth associated with bottom shear point 112 aligning with shear line 114.

Level 2 System

As illustrated in FIG. 1, a level 2 system utilizes a master key with a number of change keys under it, and each change key associated with a specific lock. For each lock associated with the master key, the rekey for the master key is in accordance with the Top-Master Rekeying method described above and the rekeying of the change key or patron keys is in accordance with the Basic Rekeying Method.

In one embodiment, a level 2 system lock utilizes five pin stacks and six master pins. Each master pin has a different thickness. The master pins are associated with four of the five pin stacks. For example, two pin stacks can have two master pins associated with each pin stack, two pin stacks can have one master pin associated with each pin stack and one pin stack will have no master pin associated with it. As will be appreciated, a master pin being associated with a pin stack does not mean that the master pin is in the pin stack but, rather that the master pin is either in the pin stack or in an associated inactive master-pin chamber. In this embodiment, the first change key (first patron key) used is a key associated with having all the master pins in the pin stack and no master pins in the inactive master-pin chambers. Starting from this orientation helps ensure that prior change keys cannot open locks that have been rekeyed.

In this embodiment, four of the pin stacks pin chambers are used to progress through all possible change key rekeys. The fifth pin stack is left without any master pins to help prevent unintentional cross keying and limit the total number of shear points in the cylinder.

Figure 14A:
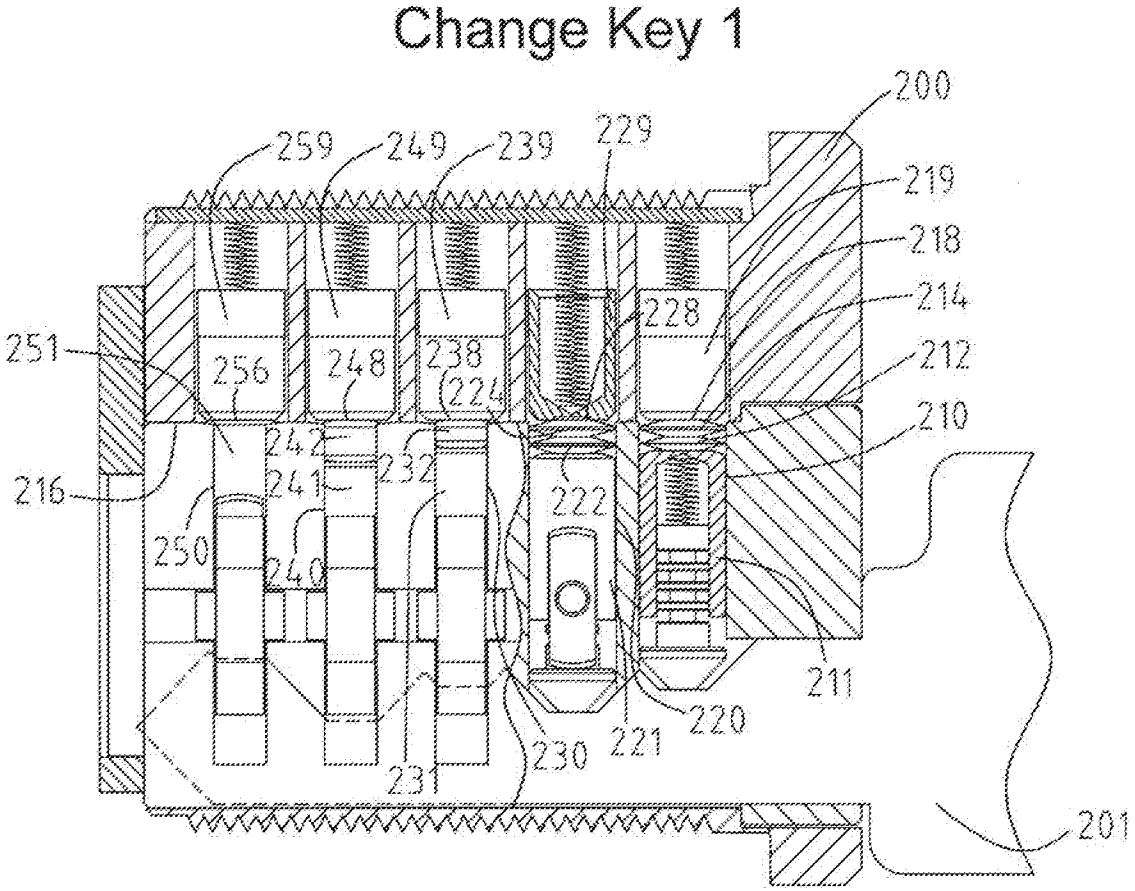
FIGS. 14A-F illustrate the key progression for rekeying the change key or patron key in a level 2 system lock in accordance with an embodiment.
Figure 14C:
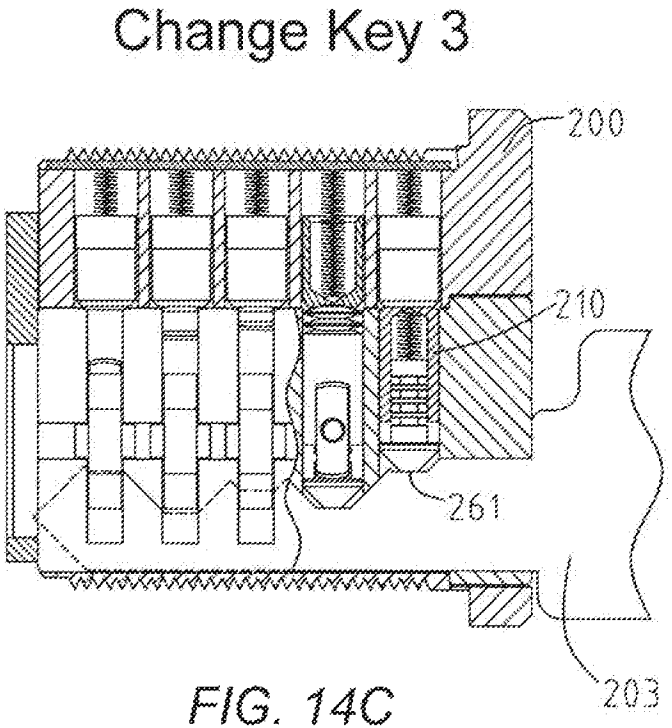
Figure 14B:
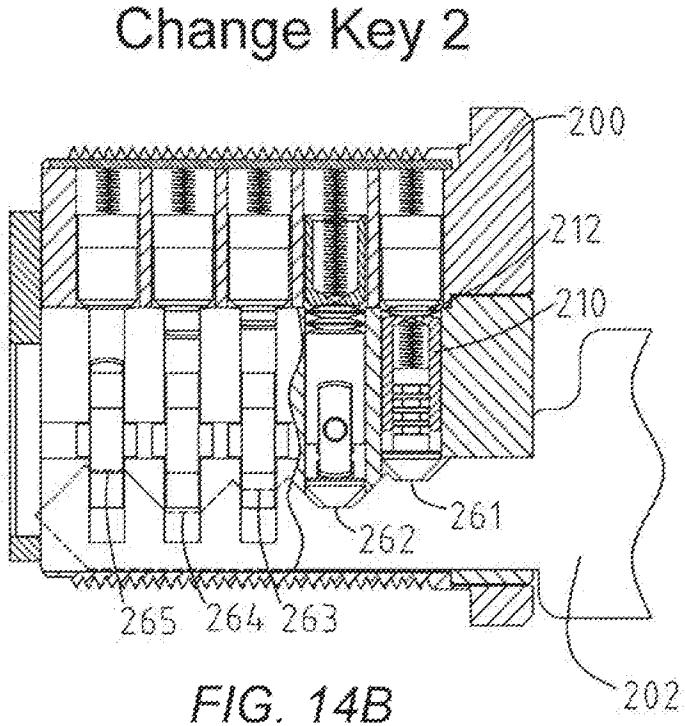
Figure 14E:
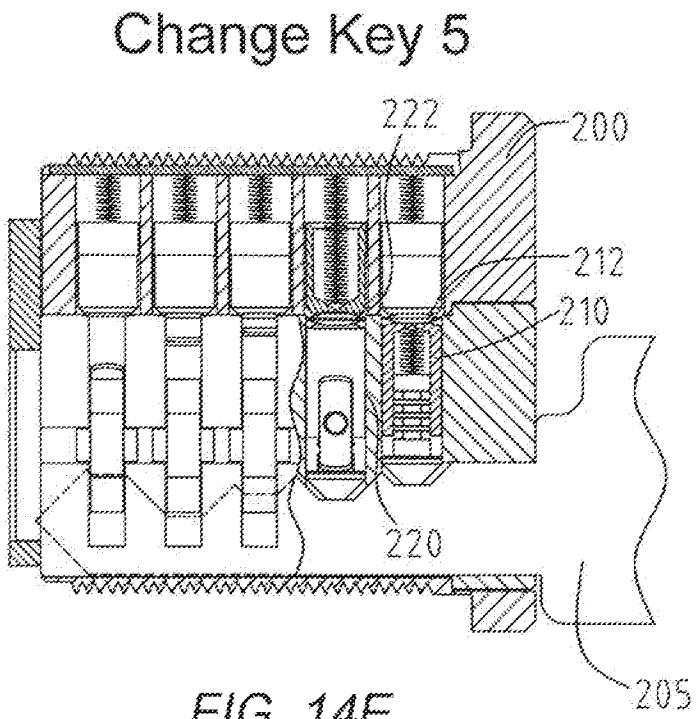
Figure 14D:
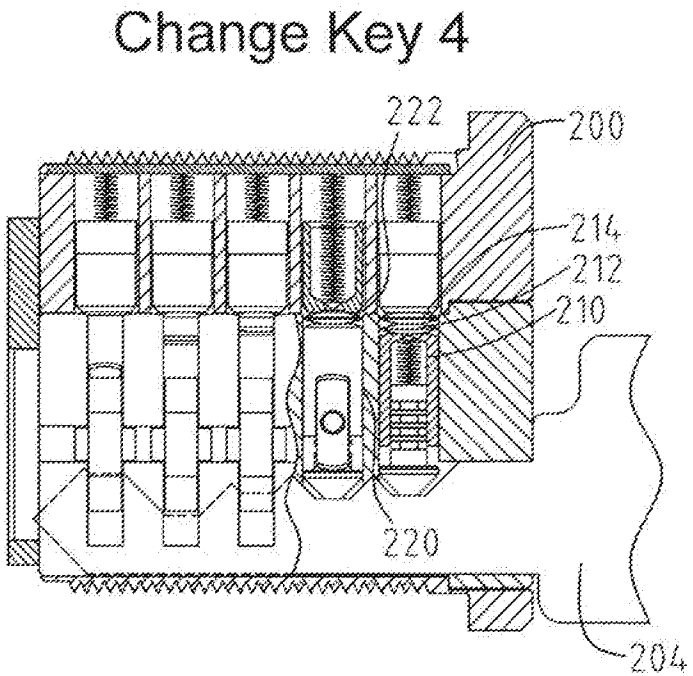
Figure 14F:
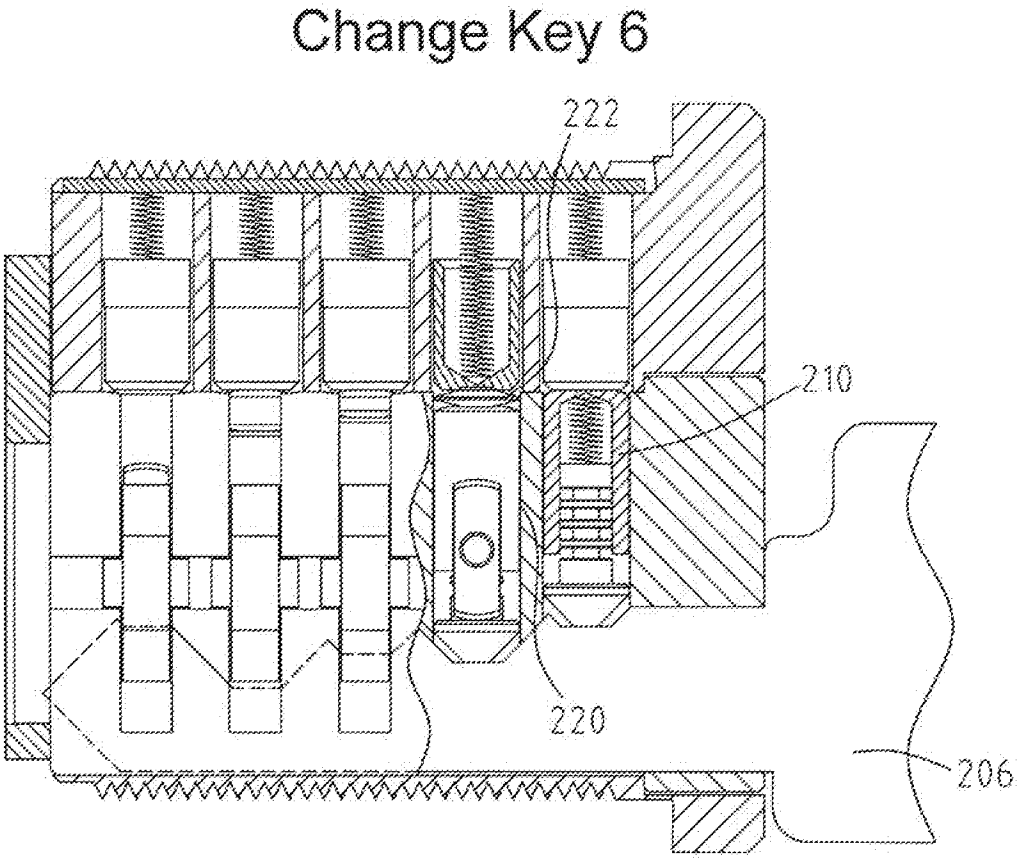

FIGS. 14A to 14F illustrate rekeying a lock from a first change key (FIG. 14A) through to a sixth change key (FIG. 14F). As illustrated in FIG. 14A, a first change key 201 is inserted into lock 200. In lock 200, a first pin stack 210 has two master pins 212 and 214 associated with and currently in pin stack 210. A second pin stack 220 also has two master pins 222 and 224 associated with and currently in pin stack 220. Third pin stack 230 has only a single master pin 232 associated with and currently in pin stack 230. Similarly, fourth pin stack 240 has only a single master pin 242 associated with and currently in pin stack 240. Finally, pin stack 250 has no master pins associated with it. Each pin stack 210, 220, 230, 240 and 250 has a driver 219, 229, 239, 249 and 259 associated with it, respectively. Also, each pin stack 210, 220, 230, 240 and 250 has a tumbler assembly 211, 221, 231, 241 and 251 associated with it, respectively. Each key for the lock has five cut-depth positions 261, 262, 263, 264 and 265 associated with pin stacks 210, 220, 230, 240 and 250, respectively.

When first change key 201 is inserted into lock 200, pin stacks 210, 220, 230 and 240 are positioned such that upper shear points 218, 228, 238 and 248 align with shear line 216. The upper shear points being the shear points between a master pin and the driver associated with the pin stack. Additionally, when first change key 201 is inserted into lock 200, pin stack 250 is positioned such that lower shear point 256 is aligned with shear line 216. The lower shear points being the shear points between a tumbler assembly and a master pin or, if no master pin is present in the pin stack, a driver.

The lock configuration after a first basic rekey is performed is illustrated in FIG. 14B. As can be seen, first pin stack 210 is changed so as to remove master pin 214. All the other pin stacks remain unchanged. First change key 201 can no longer open lock 200 because its cut depth for first cut-depth position 261 will no longer be sufficient to align a shear point with the shear line. The lock is now keyed for second change key 202 to open the lock, as illustrated.

The lock configuration after a second basic rekey is performed is illustrated in FIG. 14C. As can be seen, first pin stack 210 is changed so as to remove master pin 212; thus, first pin stack 210 now has no master pins in it. The master pins for first pin stack 210 are both located in the inactive master-pin chamber associated with first pin stack 210. All the other pin stacks remain unchanged. Neither first change key 201 nor second change key 202 can open lock 200 because their cut depth for first cut depth position 261 will no longer be sufficient to align a shear point with the shear line. The lock is now keyed for third change key 203 to open the lock, as illustrated.

The lock configuration after a third basic rekey is performed is illustrated in FIG. 14D. As can be seen, first pin stack 210 is changed so as to contain master pins 212 and 214. Additionally, second pin stack 220 is changed so as to remove master pin 224 (shown in FIG. 14A). All the other pin stacks remain unchanged. Change keys 201, 202 and 203 cannot open lock 200. The lock is now keyed for fourth change key 204 to open the lock, as illustrated.

The lock configuration after a fourth basic rekey is performed is illustrated in FIG. 14E. As can be seen, first pin stack 210 is changed so as to remove master pin 214; thus, it only contains master pin 212. Second pin stack 220 is unchanged from the previous configuration and contains only master pin 222. All the other pin stacks remain unchanged. Change keys 201, 202, 203 and 204 cannot open lock 200. The lock is now keyed for fifth change key 205 to open the lock, as illustrated.

The lock configuration after a fifth basic rekey is performed is illustrated in FIG. 14F. As can be seen, first pin stack 210 is changed so as to remove master pin 212; thus, it contains no master pins. Second pin stack 220 is unchanged from the previous configuration and contains only master pin 222. All the other pin stacks remain unchanged. Change keys 201, 202, 203, 204 and 205 cannot open lock 200. The lock is now keyed for sixth change key 206 to open the lock, as illustrated. Further, rekeyings will be apparent to one skilled in the art from the above description and the figures.

Generally, if the top-master key is to open more than one lock, the master pins in pin stacks 230 and/or 240 will be used to differentiate the locks so that the top-master key can open each lock but so that a change key from one lock will not open one of the other locks under the top-master key. However, in some situations it may be desirable to use pin stacks 230 and 240 to allow additional change keys for single lock. If so, subsequent basic rekeying can be achieved by removing the master pin from pin stack 230 and/or pin stack 240 and, for each master pin change in those stacks, following the above outlined master pin changes for pin stacks 210 and 220.

When desirable, the top-master key can be changed by rekeying the lock in accordance with the Top-Master Rekeying Method described above. Changing the top-master key results in changing the change key (patron key). Typically, the initial change key for a new top-master key has all the master pins in the pin stacks.

Level 3 System

As illustrated in FIG. 2, a level 3 system utilizes a top-master key with a number of master keys under it. Each master key in turn has a number of change keys under it. In one exemplary key progression for a level 3 system, the top-master key is rekeyed in accordance with the Top-Master Rekeying Method described above. For each lock associated with the top-master key, the rekey for the master key and the rekeying of the change keys (patron keys) are in accordance with the Basic Rekeying Method.

In one embodiment, a level 3 system lock utilizes five pin stacks and eight master pins. Typically, at least six different thicknesses can be used for the master pins. Generally, the master pins are associated with all five pin stacks. For example, three pin stacks can have two master pins associated with each, and two pin stacks can have one master pin associated with each. As will be appreciated, a master pin being associated with a pin stack does not mean that the master pin is in the pin stack but, rather that the master pin is either in the pin stack or in an associated inactive master-pin chamber. In this embodiment, three pin stacks are used to progress through all possible change key rekeys, and the other two pin chambers are used to progress through all possible master key rekeys. Which pin stacks are designated for each can vary between cylinder systems to increase variations and security between systems.

Like the level 2 system described above the first change key and first master key combination used can be associated with having all the master pins in the pin stack and no master pins in the inactive master-pin chambers. Starting from this orientation helps ensure that prior change keys cannot open locks that have been rekeyed.

In this embodiment, the change keys use upper shear points, except in pin stacks that have no master pins in them. The master keys use a mixture of lower shear points and upper shear points, and the top-master key uses lower shear points. For example, in a level 3 system where pin stacks 1, 2 and 3 are designated for change key rekeys, and pin stacks 4 and 5 are designated for master key rekeys, the top-master key will use the lower shear points for each pin stack; that is, the top-master key raises the top of all tumbler assemblies to shear line. The master keys coming under the top-master key raises the top of the tumbler assembly in chambers 1-3 to shear line thus using the lower shear point. Additionally, for pin stacks 4 and 5, the master keys raises the top of the uppermost master pin to shear line thus use the upper shear point. Naturally, if the lock has been rekeyed to a configuration where there are no master pins in either pin stack 4 or 5, the current master key will use the lower shear point for that pin stack. The change key will raise the top of the uppermost master pin in all pin stacks to shear line, thus using the upper shear point. Similarly as with the master keys, if the lock has been rekeyed such that a pin stack has no master pin, the current change key will use the lower shear point for that pin stack. This design forces lower-level keys to be slaves to higher-level keys.

As will be appreciated, the current lock system is very flexible and the above embodiments can be adapted in many ways. For example, different pin stacks can have zero, one, two or more master pins associated with them so as to increase the combinations of the locks. Additionally, the lock can have few than five pin stacks or more than five pin stacks. Such modifications will be readily apparent to one skilled in the art based on an examination of this disclosure.

Although certain preferred embodiments of the invention have been herein described in order to illustrate the principles of the invention, it will be understood that various changes and innovations in structure can be effected without departure from these principles. Changes and innovations of this type are therefore deemed to be circumscribed by the spirit and scope of the invention except as the same may be limited by the appended claims or reasonable equivalents thereof.

What is claimed is:

1. A key-operated lock comprising:

a housing;

a core rotatable mounted in the housing;

a plurality of master pins in a first configuration to allow a first patron key to open the lock; and a plurality of reconfigurable tumbler assemblies in a first arrangement to allow a first master key to open the lock;

wherein the housing, the core, the plurality of master pins and the plurality of reconfigurable tumbler assemblies are configured to have:

a key pull position in which at least the first top-master key and the first patron key are insertable into the lock so as to be able to lock and unlock the lock;

a basic rekey position in which the plurality of master pins are reconfigured by inserting a second patron key into a second configuration, wherein in the second configuration, the first patron key is not able to lock and unlock the lock from the key pull position and the second patron key is able to lock and unlock the lock from the key pull position; and a top-master rekey position in which the reconfigurable tumbler assemblies are reconfigured by insertion of a change key and a second top-master key into a second arrangement, wherein in the second arrangement the first top-master key and first patron key are not able to lock and unlock the lock from the key pull position and the second top-master key is able to lock and unlock the lock from the key pull position.

2. The key-operated lock of claim 1 wherein:

the housing has a circularly cross-sectioned bore therein defined by a bore wall, wherein the bore has an axial direction, the housing having a set of driver chambers aligned along the axial direction with each driver chamber extending radially towards the bore, and having a set of inactive master-pin chambers aligned along the axial direction with each inactive master-pin chamber extending radially towards the bore, wherein the set of inactive master-pin chambers are spaced circumferentially around the bore from the set of driver chambers and each inactive master-pin chamber aligns circumferentially with a respective driver chamber;

the core is rotatably mounted in the bore and having a main key slot and a change tool slot formed therein each extending substantially parallel to the axial direction, wherein the core has an outer cylindrical surface which meets the bore wall at a shear line;

said key-operated lock further comprising a set of pin stacks, each comprising pin stack elements including:

a driver, wherein the driver is movably mounted in one of the driver chambers for radial movement relative to the bore in the housing, and for movement partially into the bore in the housing;

at least one of the reconfigurable tumbler assemblies movably mounted in the core for radial movement relative to the bore in the body and moveable to a position projecting from the core, wherein in the key-pull position of the core the reconfigurable tumbler assembly is radially aligned with the driver, each of the reconfigurable tumbler assemblies including a plurality of releasably engaged parts movable relative to each other upon disengagement to change a dimension of the reconfigurable tumbler assemblies, wherein the releasably engaged parts are disengaged by insertion of a change tool into the change tool slot when the core is in the top-master-rekey position; and wherein for at least one of the pin stacks, the pin stack elements further comprise one or more master pins where each master pin is moveable between a position within the core above the respective reconfigurable tumbler assembly and a position in the inactive master-pin chamber when the core is in a basic rekey position in which the reconfigurable tumbler assembly is radially aligned with the set of inactive master-pin chambers.

3. The key-operated lock of claim 2, wherein the pin stack elements meet at shear points such that, when all the pin stacks have shear points coincident with the shear line, the core is free to rotate in the bore among the key pull position, the basic rekey position and the top-master rekey position; and, when at least one of the pin stacks does not have a shear point coincident with the shear line, the core is not free to rotate.

4. The key-operated lock of claim 3, wherein when the first top-master key is inserted into the main key slot, all the shear points associated with all the tumbler assemblies are coincident with the shear line, and in the top-master rekey position the lock is configured by removing the first top-master key and inserting the second top-master key such that the dimension of the reconfigurable tumbler assemblies are changed.

5. The key-operated lock of claim 4, wherein when the lock is keyed for the first patron key or the second patron key and such patron key is inserted into the main key slot, at least one shear point associated with one of the master pins and either another master pin or the driver is coincident with the shear line.

6. The key-operated lock of claim 5, wherein the lock is configured such that in the basic rekey position the master pins are reconfigured by moving at least one master pin between the position within the core above the respective reconfigurable tumbler assembly and the position in the inactive master-pin chamber.

7. The key-operated lock of claim 1, wherein each reconfigurable tumbler assembly comprises a plurality of releasably engaged parts movable relative to each other upon disengagement to change a dimension of the reconfigurable tumbler assemblies, wherein the releasably engaged parts are disengaged by insertion of the change tool into a change tool slot in the core when the lock is the top-master rekey position.

8. The key-operated lock of claim 7, wherein each reconfigurable tumbler assembly is a part of a pin stack such that there is a plurality of pin stacks in the lock, and at least one of the pin stacks includes at least one of the master pins which is moveable in and out of the at least one of the pin stacks in the basic rekey position.

9. The key-operated lock of claim 8, wherein the housing has a set of inactive master-pin chambers which retains master pins which are not in one of the pin stacks.

10. The key-operated lock of claim 9, wherein the lock is configured to have a grandmaster key, a master key and a patron key and wherein the first top-master key and second top-master key are grandmaster keys, and the master key and patron key are slave keys to the grandmaster key.

11. A method of rekeying a key-operated lock from being operable in a key pull position by a first master key and a first patron key to being operable in the key pull position by a second master key and second patron key, the method comprising:

providing the key-operated lock comprising:

a housing;

a core rotatable mounted in the housing;

a plurality of master pins in a first configuration to allow a first patron key to open the lock; and a plurality of reconfigurable tumbler assemblies in a first arrangement to allow a first master key to open the lock;

placing the lock into a master rekey position;

in the master rekey position, reconfiguring a set of reconfigurable tumbler assemblies from a first arrangement wherein the first master key operates the lock to a second configuration where the second master key operates the lock, wherein the reconfigurable tumbler assemblies are reconfigured by insertion of a change key and a second master key to place the reconfigurable tumbler assembles into a second arrangement, wherein in the second arrangement the first top-master key is not able to lock and unlock the lock from the key pull position and the second master key is able to lock and unlock the lock from the key pull position;

placing the lock in a basic rekey position wherein master pins are reconfigured such that the second patron key operates the lock, wherein in the basic rekey position, the plurality of master pins are reconfigured by inserting the second patron key into a second configuration, wherein in the second configuration, the first patron key is not able to lock and unlock the lock from the key pull position and the second patron key is able to lock and unlock the lock from the key pull position.

12. The method of claim 11, wherein the step of placing the lock into the master rekey position comprises:

inserting the first patron key into a main key slot of a core rotatably mounted in a bore of the housing, wherein the set of reconfigurable tumbler assemblies are mounted in the core, and the first patron key is inserted when the core is in the key-pull position in which the set of reconfigurable tumbler assemblies are radially aligned with a set of drivers mounted in the housing, and wherein the set of reconfigurable tumbler assemblies are movably mounted in the core for radial movement relative to the bore in the body;

turning the first patron key to thus turn the core to the basic rekey position in which the set of reconfigurable tumbler assemblies is radially aligned with a set of inactive master pin chambers in the housing;

removing the first patron key from the main key slot;

inserting the first master key into the main key slot; and turning the first master key so as to move the core to the master rekey position.

13. The method of claim 12, wherein the step of reconfiguring the set of tumbler assemblies comprises:

inserting the change tool into a change tool slot in the core;

removing the first master key from the main key slot;

inserting the second master key into the main key slot, wherein inserting the second master key changes a dimension of at least one of the reconfigurable tumbler assemblies thus changing the reconfigurable tumbler assemblies from the first arrangement to the second arrangement; and removing the change tool.

14. The method of claim 13, wherein each tumbler assembly of the plurality of reconfigurable tumbler assemblies includes a plurality of releasably engaged parts movable relative to each other upon disengagement to change the dimension of the respective tumbler assembly, and wherein insertion of the change tool disengages the engaged parts when the core is in the master rekey position and removing the change tool reengages the releasably engaged parts thus rekeying the lock for the second master key.

15. The method of claim 14, wherein the step of placing the lock in the basic rekey position comprises:

turning the second master key so as to move the core to the basic rekey position;

removing the second master key; and inserting the second patron key such that one or more of the master pins move between a position in one of the inactive master-pin chambers and a position within the core above one of the tumbler assemblies thus rekeying the lock for the second patron key.

* * * * *